US007718331B2

(12) United States Patent
Uematsu et al.

(10) Patent No.: US 7,718,331 B2
(45) **Date of Patent: *May 18, 2010**

(54) ELECTROPHOTOGRAPHIC PHOTOSENSITIVE MEMBER WITH DEPRESSED PORTIONS, PROCESS CARTRIDGE HOLDING THE ELECTROPHOTOGRAPHIC PHOTOSENSITIVE MEMBER AND ELECTROPHOTOGRAPHIC APPARATUS WITH THE ELECTROPHOTOGRAPHIC PHOTOSENSITIVE MEMBER

(75) Inventors: Hiroki Uematsu, Suntoh-gun (JP); Harunobu Ogaki, Suntoh-gun (JP); Masataka Kawahara, Mishima (JP); Atsushi Ochi, Numazu (JP); Akira Shimada, Suntoh-gun (JP); Akio Maruyama, Tokyo (JP); Kyoichi Teramoto, Abiko (JP); Toshihiro Kikuchi, Yokohama (JP); Akio Koganei, Ichikawa (JP); Takayuki Sumida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/770,127

(22) Filed: Jun. 28, 2007

(65) Prior Publication Data

US 2008/0124637 A1 May 29, 2008

Related U.S. Application Data

(63) Continuation of application No. PCT/JP2007/051864, filed on Jan. 30, 2007.

(30) Foreign Application Priority Data

Jan. 31, 2006 (JP) ..... 2006-022896
Jan. 31, 2006 (JP) ..... 2006-022898
Jan. 31, 2006 (JP) ..... 2006-022899
Jan. 31, 2006 (JP) ..... 2006-022900
Jan. 26, 2007 (JP) ..... 2007-016217

(51) Int. Cl.
*G03G 5/00* (2006.01)

(52) U.S. Cl. ..... 430/56; 430/66; 430/132; 430/133

(58) Field of Classification Search ..... 430/56, 430/66, 130, 132, 133
See application file for complete search history.

(56) References Cited

U.S. PATENT DOCUMENTS 5,114,814 A 5/1992 Sakoh et al. ..... 430/46

(Continued)

FOREIGN PATENT DOCUMENTS

JP 52-026226 2/1977

(Continued)

OTHER PUBLICATIONS

English language machine translation of JP 2001066814 (2001).*

*Primary Examiner*—Christopher RoDee
(74) *Attorney, Agent, or Firm*—Fitzpatrick, Cella, Harper & Scinto

(57) ABSTRACT

An electrophotographic photosensitive member is disclosed which is excellent in cleaning performance, has improved durability, and suppresses image defects in various environments. The electrophotographic photosensitive member has a support and a photosensitive layer provided on the support. Depressed portions independent of one another are formed on the surface of the electrophotographic photosensitive member so that the number of the depressed portions per 100 μm square is 76 or more and 1,000 or less. The openings of the depressed portions have an average major axis diameter of more than 3.0 μm and 14.0 μm or less.

8 Claims, 23 Drawing Sheets

U.S. PATENT DOCUMENTS

| | | | | |
|---|---|---|---|---|
| 6,221,552 | B1 * | 4/2001 | Street et al. | 430/130 |
| 7,186,489 | B2 | 3/2007 | Uematsu et al. | 430/66 |
| 7,226,711 | B2 | 6/2007 | Amamiya et al. | 430/58.7 |
| 2005/0255393 | A1 | 11/2005 | Nakata et al. | 430/56 |
| 2007/0254232 | A1 | 11/2007 | Kawahara et al. | 430/119.71 |
| 2008/0019735 | A1 | 1/2008 | Ogaki et al. | 399/159 |

FOREIGN PATENT DOCUMENTS

| | | |
|---|---|---|
| JP | 53-092133 | 8/1978 |
| JP | 57-094772 | 6/1982 |
| JP | 01-099060 | 4/1989 |
| JP | 02-139566 | 5/1990 |
| JP | 02-150850 | 6/1990 |
| JP | 2001-066814 | 3/2001 |
| WO | WO 2005/093518 | 10/2005 |

* cited by examiner

ELECTROPHOTOGRAPHIC PHOTOSENSITIVE MEMBER WITH DEPRESSED PORTIONS, PROCESS CARTRIDGE HOLDING THE ELECTROPHOTOGRAPHIC PHOTOSENSITIVE MEMBER AND ELECTROPHOTOGRAPHIC APPARATUS WITH THE ELECTROPHOTOGRAPHIC PHOTOSENSITIVE MEMBER

This application is a continuation of International Application No. PCT/JP2007/051864 filed on Jan. 30, 2007, which claims the benefit of Japanese Patent Applications No. 2006-022896 filed Jan. 31, 2006, No. 2006-022898 filed Jan. 31, 2006, No. 2006-022899 filed Jan. 31, 2006, No. 2006-022900 filed Jan. 31, 2006 and No. 2007-016217 filed Jan. 26, 2007.

BACKGROUND OF THE INVENTION

1. Field of the Invention

The present invention relates to an electrophotographic photosensitive member, and a process cartridge and an electrophotographic apparatus each having the electrophotographic photosensitive member.

2. Description of the Related Art

An organic electrophotographic photosensitive member having a support and a photosensitive layer (organic photosensitive layer) provided thereon using an organic material as a photoconductive substance (a charge generating substance or a charge transporting substance) has been in widespread use as an electrophotographic photosensitive member because of its advantages, that is, a low cost and high productivity. An electrophotographic photosensitive member having a lamination type photosensitive layer with a charge generating layer containing a charge generating substance and a charge transporting layer containing a charge transporting substance superposed one on the other has been the mainstream of the organic electrophotographic photosensitive member because of its advantages such as high sensitivity and a possibility of designing various materials. Examples of the charge generating substance include a photoconductive dye and a photoconductive pigment, and examples of the charge transporting substance include a photoconductive polymer and a photoconductive low-molecular-weight compound.

Since electrical external force or/and mechanical external force is/are directly applied to the surface of an electrophotographic photosensitive member during charging, exposure, development, transfer or cleaning, a large number of problems caused by those external forces occur on the surface. Specific examples of the problems include: deterioration in durability and transfer efficiency of the electrophotographic photosensitive member due to flaws on a surface layer of the electrophotographic photosensitive member or generation of wear; melt adhesion of toner; and image defects due to cleaning failure.

To deal with those problems, active investigation has been conducted to improve a surface layer in an electrophotographic photosensitive member. To be specific, investigation has been made into the improvement of a resin from which the surface layer is formed and into the addition of filler or water repellent material from the aspect of material for the purposes of increasing the strength of the surface layer and of imparting high releasability or lubricity to the surface layer.

Meanwhile, as an improvement from the aspect of physical properties, investigation has been made also to solve the above-mentioned problems by suitably roughening the surface layer. Since the roughening of the surface layer can reduce a contact area at which a toner, a charging member, a transferring member or a cleaning member is brought into contact with the surface layer, it is expected to exert an effect of improving releasability or an effect of reducing frictional force. The frictional force between the surface layer and a cleaning blade is particularly large, which is liable to raise a problem of deterioration in cleaning performance or in durability. Specific examples of the problems resulting from deterioration in cleaning performance include cleaning failure due to: chattering or turn-up of a cleaning blade; and gouging or chipping of a blade edge. Herein, the chattering of a cleaning blade is a phenomenon in which the cleaning blade vibrates owing to an increase in frictional resistance between the cleaning blade and the surface of an electrophotographic photosensitive member. In addition, the turn-up of a cleaning blade is a phenomenon in which the cleaning blade turns up in the direction in which the electrophotographic photosensitive member moves. Specific examples of the problems resulting from deterioration in durability include an increase in the amount of wear of the surface layer attributable to an increase in frictional resistance and the generation of flaws due to locally concentrated pressure. The above-mentioned roughening is expected to act advantageously on those problems.

An influence of toner (toner particles and an external additive) on both an electrophotographic photosensitive member and a cleaning member must be taken into consideration for expressing cleaning performance.

In general, good cleaning performance is considered to be expressed in the state that toner remaining on the surface of the photosensitive member without being transferred intervenes between a cleaning blade and the surface of an electrophotographic photosensitive member and reduces the frictional resistance generated between the two. However, in some electrophotographic processes, the amount of the above-mentioned toner intervening between the cleaning blade and the surface of the electrophotographic photosensitive member may be extremely small. For example, when a large number of patterns having low printing density are printed, or when monochrome images are continuously printed in an electrophotographic system according to a tandem mode, the frictional resistance between a cleaning blade and the surface of an electrophotographic photosensitive member is considered to be apt to increase particularly remarkably, and so the above-mentioned problem of deterioration in cleaning performance or in durability tends to be generated. Further, a problem concerning melt adhesion of toner resulting from an increase in frictional resistance may occur.

Those problems occurring between a cleaning blade and an electrophotographic photosensitive member generally tend to be remarkable as the mechanical strength of the surface layer of the electrophotographic photosensitive member increases and the peripheral surface of the electrophotographic photosensitive member is more difficult to abrade. Accordingly, the roughening of the surface layer is expected to be a very effective measure for alleviating a detrimental effect of such an increase in strength of the surface layer by the improvement of the resin of the surface layer as described above.

Examples of a technique of roughening the surface layer of an electrophotographic photosensitive member include:

a technique of controlling the surface roughness (roughness of the peripheral surface) of the electrophotographic photosensitive member within a specific range for facilitating the separation of a transfer material from the surface of the electrophotographic photosensitive member and a method of roughening the surface of the electrophotographic photosensitive member in an orange peel state by controlling drying conditions for forming the surface layer (Japanese Patent Application Laid-Open No. S53-92133);

a technique of roughening the surface of the electrophotographic photosensitive member by incorporating particles into the surface layer (Japanese Patent Application Laid-Open No. S52-26226);

a technique of roughening the surface of the electrophotographic photosensitive member by polishing the surface of the surface layer with a metallic wire brush (Japanese Patent Application Laid-Open No. S57-94772);

a technique of roughening the surface of an organic electrophotographic photosensitive member for solving the turn-up of a cleaning blade and the chipping of the edge portion of a blade, which become problems when the photosensitive member is used in an electrophotographic apparatus using a specific cleaning device and specific toner, and having a specific process speed or higher (Japanese Patent Application Laid-Open No. H01-099060);

a technique of roughening the surface of the electrophotographic photosensitive member by polishing the surface of the surface layer with a filmy abrasive (Japanese Patent Application Laid-Open No. H02-139566); and a technique of roughening the peripheral surface of the electrophotographic photosensitive member by blasting (Japanese Patent Application Laid-Open No. H02-150850).

However, details of the surface profile of the electrophotographic photosensitive member roughened as described above are not specifically described.

The roughening of surfaces according to the prior art exerts a certain effect of reducing the above-mentioned frictional force between a surface layer and a cleaning blade because the surface layer is moderately roughened, but an additional improvement is being sought. In the respect that the surface profile of the surface layer is streaky or is in indefinite form or has unevenness with a difference in size, an additional improvement is being sought in order to solve problems on how to control cleaning performance and prevent a developer or paper powder from adhering, from a microscopic viewpoint.

An electrophotographic photosensitive member having a predetermined dimple shape has been proposed as a result of detailed analysis and investigation focusing attention to the control of the surface profile of an electrophotographic photosensitive member (WO 2005/093518 A). This proposal has hit a directionality to solve problems concerning cleaning performance and rubbing memory, but an additional improvement in performance of the electrophotographic photosensitive member is being sought.

In addition, a technique of subjecting the surface of an electrophotographic photosensitive member to compression forming with a stamper having unevenness in the form of wells has been disclosed (Japanese Patent Application Laid-Open No. 2001-066814). This technique is expected to be more effective in solving the above-mentioned problems because it enables an unevenness profile with independent shapes to be formed on the surface of an electrophotographic photosensitive member with higher controllability than the techniques disclosed in the above patent documents. According to this technique, it has been reported that an unevenness profile in the form of wells each having a length or pitch of 10 to 3,000 nm is formed on the surface of an electrophotographic photosensitive member, and releasability of toner is improved and nip pressure for a cleaning blade can be reduced, whereby the wear of the photosensitive member can be reduced. However, a photosensitive member having such an unevenness profile tends to cause image defects resulting from cleaning failure under a low-temperature, low-humidity environment. In addition, a problem of image defects due to melt adhesion of toner starting from depressed portions in the form of wells having a length of 10 to 3,000 nm as described above is liable to occur. This phenomenon tends to be particularly remarkable in a high-temperature, high-humidity environment where the adhesive force or frictional force between the surface of an electrophotographic photosensitive member and toner or a member coming in contact with the surface is apt to be large.

As described above, the prior art exerts a certain effect of improving the durability or cleaning performance of an electrophotographic photosensitive member and a certain effect of suppressing image defects, but is now still susceptible to improvement in order that the overall performance of an electrophotographic photosensitive member is further improved.

Therefore, it is necessary to develop an electrophotographic photosensitive member exerting good cleaning performance and causing no image defects in various environments.

SUMMARY OF THE INVENTION

An object of the present invention is to provide an electrophotographic photosensitive member which solves the above-mentioned problems of the prior art, is excellent in cleaning performance and suppresses the occurrence of image defects due to cleaning failure or melt adhesion, and a process cartridge and an electrophotographic apparatus each having the electrophotographic photosensitive member.

The inventors of the present invention have made extensive studies. As a result, the inventors have found that the above-mentioned problems can be effectively solved by forming certain depressed portions on the surface of an electrophotographic photosensitive member. Thus, the inventors have completed the present invention.

The present invention relates to an electrophotographic photosensitive member including a support and a photosensitive layer provided on the support, in which a plurality of depressed portions independent of one another are formed on the surface of the electrophotographic photosensitive member, the number of the depressed portions per 100 μm square is 76 or more and 1,000 or less, and openings of the depressed portions have an average major axis diameter of more than 3.0 μm and 14.0 μm or less.

In addition, the present invention relates to a process cartridge which integrally supports the electrophotographic photosensitive member and at least one device selected from the group consisting of a charging device, a developing device and a cleaning device, and is detachably mountable to the main body of an electrophotographic apparatus.

Further, the present invention relates to an electrophotographic apparatus including the electrophotographic photosensitive member, a charging device, an exposing device, a developing device and a transferring device. According to the present invention, it is possible to provide an electrophotographic photosensitive member which is excellent in cleaning performance and suppresses the occurrence of image defects, and a process cartridge and an electrophotographic apparatus each having the electrophotographic photosensitive member.

Further features of the present invention will become apparent from the following description of exemplary embodiments with reference to the attached drawings.

DESCRIPTION OF THE EMBODIMENTS

Figure 1A:
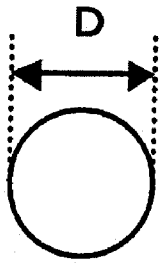
FIG. 1A is a view illustrating an example of the opening shape of each depressed portion on the surface of the electrophotographic photosensitive member of the present invention.
Figure 1B:
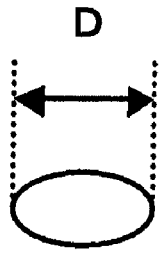
FIG. 1B is a view illustrating an example of the opening shape of each depressed portion on the surface of the electrophotographic photosensitive member of the present invention.
Figure 1C:
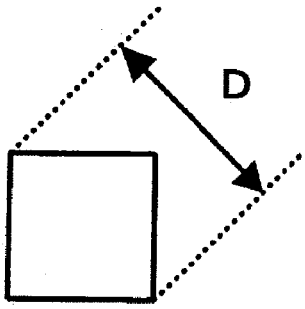
FIG. 1C is a view illustrating an example of the opening shape of each depressed portion on the surface of the electrophotographic photosensitive member of the present invention.
Figure 1D:
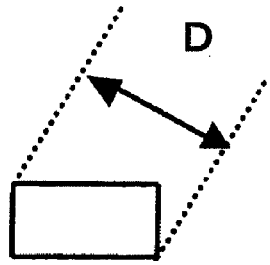
FIG. 1D is a view illustrating an example of the opening shape of each depressed portion on the surface of the electrophotographic photosensitive member of the present invention.
Figure 1E:
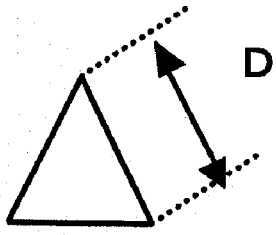
FIG. 1E is a view illustrating an example of the opening shape of each depressed portion on the surface of the electrophotographic photosensitive member of the present invention.
Figure 1F:
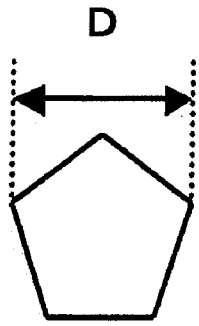
FIG. 1F is a view illustrating an example of the opening shape of each depressed portion on the surface of the electrophotographic photosensitive member of the present invention.
Figure 1G:
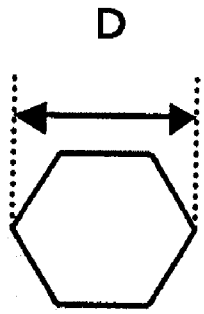
FIG. 1G is a view illustrating an example of the opening shape of each depressed portion on the surface of the electrophotographic photosensitive member of the present invention.

The term "depressed portions independent of one another" as used in the present invention refers to depressed portions present in such a state that each of the depressed portions is clearly distinguishable from the others.

FIGS. 1A to 1G each illustrate a specific example of the opening shape of each depressed portion formed in the surface of an electrophotographic photosensitive member in the present invention, and FIGS. 2A to 2G each illustrate an example of the sectional shape of each depressed portion. In FIGS. 1A to 1G and FIGS. 2A to 2G, reference character D represents a major axis diameter, and reference character H represents a depth. The opening of each depressed portion can be formed into various shapes such as a circle, an ellipse, a square, a rectangle, a triangle, a pentagon, and a hexagon illustrated in FIGS. 1A to 1G. In addition, the section of each depressed portion can be formed into various shapes as illustrated in FIGS. 2A to 2G, for example, shapes having edges such as a triangle, a quadrangle and a polygon, wavy shapes each formed of a continuous curve, and shapes in which part or all of the edges of the triangle, quadrangle, or polygon have been transformed into a curve(s).

All of the depressed portions formed on the surface of the electrophotographic photosensitive member may be identical to each other in shape, size, and depth, or some of the depressed portions may have different shapes, different sizes, and different depths.

As illustrated in FIGS. 1A to 1G, the major axis diameter of the opening of each depressed portion is defined as the length of a straight line having the longest length out of the straight lines crossing the opening of each depressed portion. For example, the diameter of a circle is adopted as a major axis diameter, the major axis of an ellipse is adopted as a major axis diameter, and the longer diagonal line of a quadrangle is adopted as a major axis diameter. In the measurement of a major axis diameter, for example, when the boundary between a depressed portion and a non-depressed portion is not clear as illustrated in FIG. 2C, the opening shape of the depressed portion is determined with reference to a smooth surface before the formation of the depressed portion as a standard S in consideration of the sectional shape of the depressed portion, and the longest length obtained in the same manner as described above is defined as a major axis diameter. Further, when a flat portion is unclear as illustrated in FIG. 2F, central lines m are drawn in the sectional views of adjacent depressed portions, and a major axis diameter is defined.

The depressed portions of the present invention are formed at least on the surface of the electrophotographic photosensitive member. The depressed portions in the surface of the photosensitive member may be formed over the entire region of the surface of the photosensitive member, or may be formed in part of the surface. The depressed portions are preferably formed at least in a surface portion coming in contact with a cleaning blade in order for the electrophotographic photosensitive member to exert good performance.

In the present invention, the number of the depressed portions formed per 100 μm square is preferably 76 or more and 1,000 or less, and more preferably 100 or more and 500 or less. In addition, the openings of the depressed portions have an average major axis diameter of preferably more than 3.0 μm and 14.0 μm or less, and more preferably 5 μm or more and 10 μm or less. Even when the average major axis diameter is more than 3.0 μm, in the case where the number of the depressed portions per 100 μm square is less than 76, the effect of the present invention tends to be difficult to achieve because the above-mentioned effect of reducing the frictional force between the surface of the electrophotographic photosensitive member and a cleaning blade cannot be sufficiently exhibited. In addition, when the average major axis diameter is less than 3.0 μm, even in the case where the number of the depressed shape portions per 100 μm square is 76 or more, melt adhesion of toner to the surface of the photosensitive member tends to occur. This phenomenon is apt to be remarkable particularly in a high-temperature, high-humidity environment.

In the present invention, the above-mentioned 100 μm square region is set as described below. The surface of the electrophotographic photosensitive member is divided into four identical portions in the rotation direction of the photosensitive member. Each of the four identical portions is divided into 25 identical portions in the direction perpendicular to the rotation direction of the photosensitive member, whereby a total of 100 regions are obtained. The inside of each of the regions is provided with a 100 μm square region. The average major axis diameter in the present invention is defined as an average value obtained by subjecting the major axis diameters of the respective depressed portions per 100 μm square to statistical processing in accordance with the above-mentioned definition.

Further, in the present invention, the number of depressed portions having a major axis diameter of 3.0 μm or less in the statistical processing is preferably small, and more preferably zero. Even when the average major axis diameter per unit area is larger than 3.0 μm, the melt adhesion of toner to the surface of the photosensitive member tends to occur as the number of depressed portions having a major axis diameter of 3.0 μm or less increases. To be specific, depressed portions having a major axis diameter of 3.0 μm or less preferably account for 50 number % or less of all depressed portions, and more preferably account for 10 number % or less of all depressed portions.

Figure 2A:
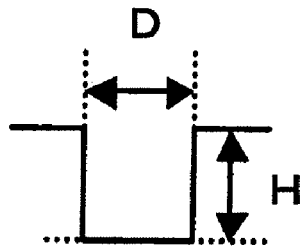
FIG. 2A is a view illustrating an example of the sectional shape of each depressed portion on the surface of the electrophotographic photosensitive member of the present invention.
Figure 2B:
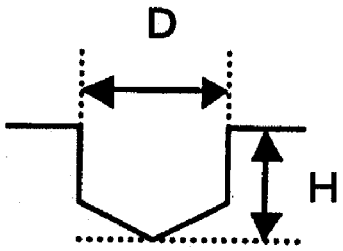
FIG. 2B is a view illustrating an example of the sectional shape of each depressed portion on the surface of the electrophotographic photosensitive member of the present invention.
Figure 2C:
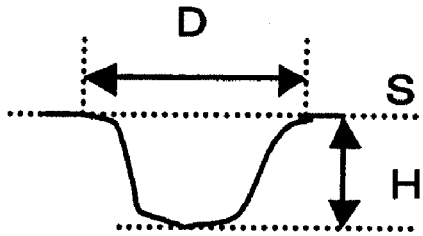
FIG. 2C is a view illustrating an example of the sectional shape of each depressed portion on the surface of the electrophotographic photosensitive member of the present invention.
Figure 2D:
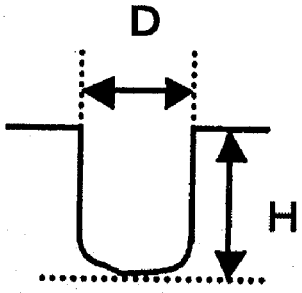
FIG. 2D is a view illustrating an example of the sectional shape of each depressed portion on the surface of the electrophotographic photosensitive member of the present invention.
Figure 2E:
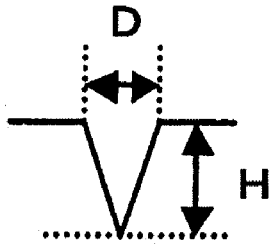
FIG. 2E is a view illustrating an example of the sectional shape of each depressed portion on the surface of the electrophotographic photosensitive member of the present invention.
Figure 2F:
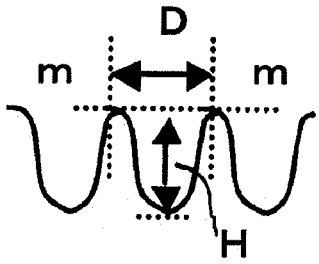
FIG. 2F is a view illustrating an example of the sectional shape of each depressed portion on the surface of the electrophotographic photosensitive member of the present invention.
Figure 2G:
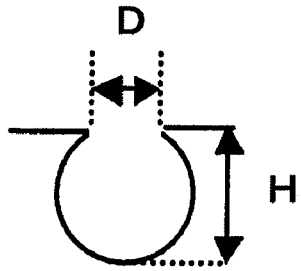
FIG. 2G is a view illustrating an example of the sectional shape of each depressed portion on the surface of the electrophotographic photosensitive member of the present invention.

As illustrated in FIGS. 2A and 2B, the depth of a depressed portion in the present invention is defined as the longest distance between a major axis diameter and the bottom surface of the depressed portion in the above-mentioned section of the depressed portion used for the definition of the major axis diameter. The depth is measured as described below as in the case of the above-mentioned measurement of an average major axis diameter. The surface of the electrophotographic photosensitive member is divided into four identical portions in the rotation direction of the photosensitive member. Each of the four identical portions is divided into 25 identical portions in the direction perpendicular to the rotation direction of the photosensitive member, whereby a total of 100 regions are obtained. The inside of each of the regions is provided with a 100 μm square region, and the depth of a depressed portion in the square region is measured. In addition, an average depth is defined as an average value obtained by subjecting the depths of the respective depressed portions per 100 μm square to statistical processing in accordance with the above-mentioned definition.

In the present invention, the depth of a depressed portion is preferably 0.1 μm or more, and more preferably 0.5 μm or more. If the depth is less than 0.1 μm, the effect of the present invention tends to be difficult to achieve.

In the present invention, further, the openings of the depressed portions have an area ratio of preferably 40% or more and 99% or less, and more preferably 60% or more to 80% or less. When the area ratio of the openings of the depressed portions is excessively small, the effect of the present invention is difficult to achieve. The term "area ratio of the openings of the depressed portions" refers to a proportion of the total area of the openings of the depressed portions in the above-mentioned 100 μm square region determined by the following expression:

{Total area of openings of depressed portions/(total area of openings of depressed portions+total area of non-depressed portions)}×100.

In the present invention, the respective depressed portions can be arbitrarily arranged, and the arrangement of the depressed portions can be optimized.

In the present invention, the shape of a depressed portion on the surface of the electrophotographic photosensitive member can be measured with, for example, a commercially available laser microscope, optical microscope, electron microscope, or atomic force microscope.

Examples of a usable laser microscope include: an ultradepth profile measuring microscope VK-8550, an ultradepth profile measuring microscope VK-9000, and an ultradepth profile measuring microscope VK-9500 (each of which was manufactured by KEYENCE CORPORATION); a surface profile measuring system Surface Explorer SX-520 DR model (manufactured by Ryoka Systems Inc); a scanning confocal laser microscope OLS 3000 (manufactured by OLYMPUS CORPORATION); and a real color confocal microscope OPTELICS C130 (manufactured by Lasertec Corporation).

Examples of a usable optical microscope include: a digital microscope VHX-500 and a digital microscope VHX-200 (each of which was manufactured by KEYENCE CORPORATION); and a 3D digital microscope VC-7700 (manufactured by OMRON Corporation).

Examples of a usable electron microscope include: a 3D real surface view microscope VE-9800 and a 3D real surface view microscope VE-8800 (each of which was manufactured by KEYENCE CORPORATION); a scanning electron microscope Conventional/Variable Pressure SEM (manufactured by SII NanoTechnology Inc); and a scanning electron microscope SUPERSCAN SS-550 (manufactured by Shimadzu Corporation).

Examples of a usable atomic force microscope include: a nanoscale hybrid microscope VN-8000 (manufactured by KEYENCE CORPORATION); a scanning probe microscope NanoNavi station (manufactured by SII NanoTechnology Inc); and a scanning probe microscope SPM-9600 (manufactured by Shimadzu Corporation).

The number, major axis diameters, and depths of the depressed portions in a field of view to be measured can be measured with any one of the above-mentioned microscopes at a predetermined magnification. Further, the average major axis diameter, average depth and area ratio of the openings of the depressed portions per unit area can be calculated.

Measurement utilizing an analysis program provided by a Surface Explorer SX-520 DR model will be described as an example. An electrophotographic photosensitive member to be measured is placed on a work placement table and subjected to tilt adjustment so as to be horizontal, and three-dimensional shape data on the peripheral surface of the electrophotographic photosensitive member is acquired according to a wave mode. In this case, the magnification of an objective lens is set at 50×, and observation may be made in a field of view of 100 μm×100 μm (10,000 μm 2). In this way, the measurement is performed for a 100 μm square region provided for the inside of each of a total of 100 regions obtained by: dividing the surface of the photosensitive member to be measured into four identical portions in the rotation direction of the photosensitive member; and dividing each of the four identical portions into 25 identical portions in the direction perpendicular to the rotation direction of the photosensitive member.

Next, contour line data on the surface of the electrophotographic photosensitive member is displayed by using a particle analysis program in data analysis software.

Pore analysis parameters such as the shape, major axis diameter, depth and opening area of the depressed portion can be optimized in accordance with the depressed portion. For example, when depressed portions having a major axis diameter of about 10 μm are observed and measured, the upper limit of a major axis diameter, the lower limit of a major axis diameter, the lower limit of a depth, and the lower limit of a volume may be set to be 15 μm, 1 μm, 0.1 μm, and 1 $\mu m^3$ or more, respectively. Then, the number of depressed portions that can be judged to be depressed portions on a screen to be analyzed is counted, and the counted number is defined as the number of depressed portions.

Alternatively, the total opening area of the depressed portions is calculated from the total of the opening areas of the respective depressed portions determined by using the above-mentioned particle analysis program in the same field of view as described above and under the same analysis conditions as described above, and the area ratio of the openings of the depressed portions (hereinafter simply referred to as "area ratio") may be calculated according to the following expression:

{Total opening area of depressed portions/(total opening area of depressed portions+total area of non-depressed portions)}×100.

<Method Of Forming Depressed Portions On Surface of Electrophotographic Photosensitive Member According to the Present Invention>

A method of forming depressed portions is not particularly limited as long as the above-mentioned requirements for the depressed portions are satisfied. Examples of the method include: a method of forming depressed portions on the surface of an electrophotographic photosensitive member by irradiating the surface with laser light having such an output characteristic that a pulse width is 100 nanoseconds (ns) or less; a method in which a mold having a predetermined shape is brought into pressure contact with the surface of an electrophotographic photosensitive member to transfer the shape; and a method in which condensation is generated, or dew is condensed, on the surface of the surface layer of an electrophotographic photosensitive member at the time of forming the surface layer.

The method of forming depressed portions by irradiation with laser light having such an output characteristic that a pulse width is 100 nanoseconds (ns) or less will be described. Specific examples of laser to be used in the method include an excimer laser using a gas such as ArF, KrF, XeF, or XeCl as a laser medium, and a femto-second laser using titanium sapphire as a medium. Further, the laser light in the above-mentioned laser light irradiation has a wavelength of preferably 1,000 nm or less. The above-mentioned excimer laser emits laser light in the following process. First, high energy such as discharge, an electron beam or an X ray is applied to a mixed gas containing a noble gas such as Ar, Kr or Xe and a halogen gas such as F or Cl so that the above-mentioned elements are bonded to each other by excitation. After that, excimer laser light is emitted by dissociation of the elements due to the fall of each of the elements into its ground state. Examples of a gas to be used in the above-mentioned excimer laser include ArF, KrF, XeCl and XeF. Any one of the gases may be used, and KrF or ArF is particularly preferable.

Figure 3:
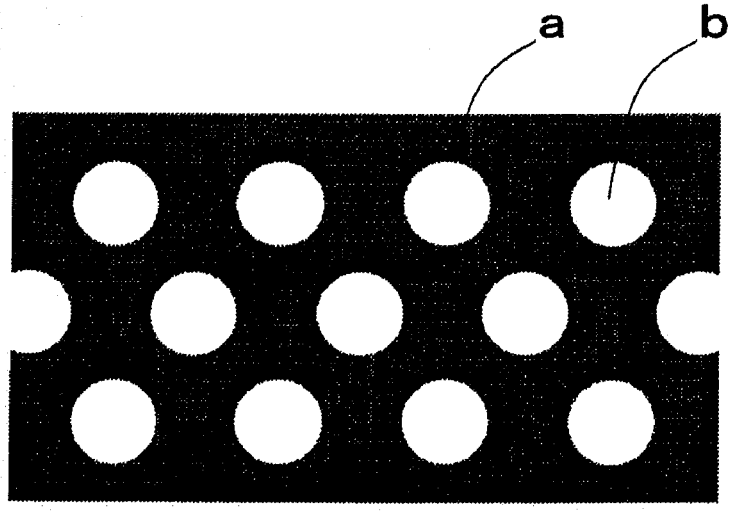
FIG. 3 is a partially enlarged view illustrating an example of the arrangement pattern of a mask to be used in the formation of depressed portions in the present invention.
Figure 4:
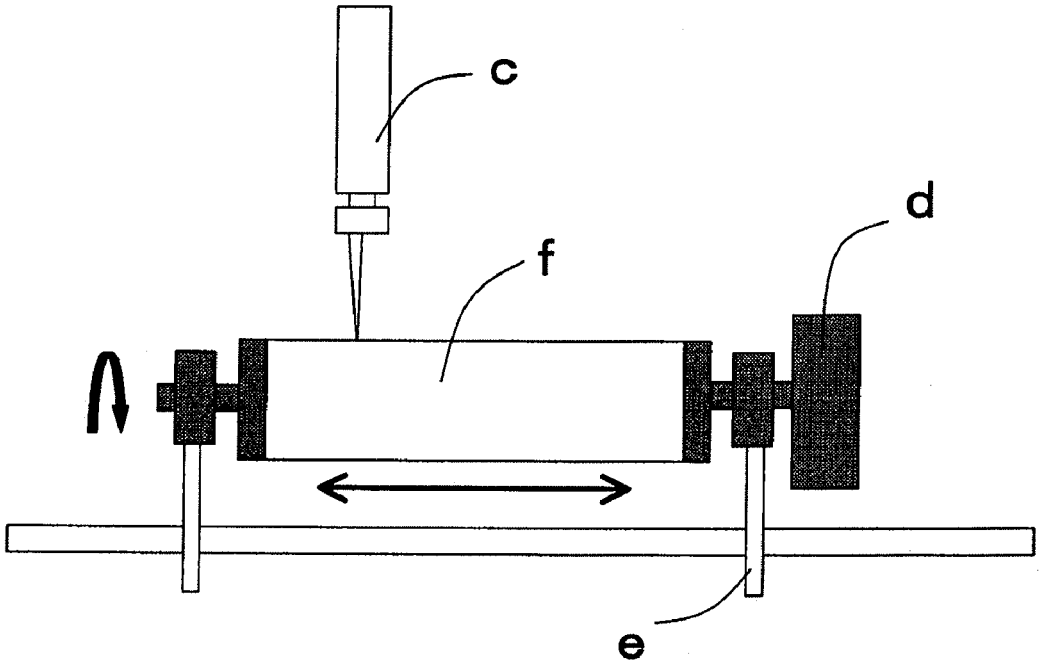
FIG. 4 is a schematic view illustrating an example of the constitution of a laser processing apparatus in the present invention.

In the formation of depressed portions, such a mask as illustrated in FIG. 3 is used in which an opaque area(s) to laser light "a" and transparent areas to laser light "b" are appropriately arranged. Only the laser light transmitted through the mask is converged with a lens and applied to a substance to be processed, whereby depressed portions having desired shapes and desired arrangement can be formed. The foregoing process can be performed within a short time period because a large number of depressed portions in a certain area can be processed instantaneously and simultaneously irrespective of their shapes and areas. Several square millimeters to several square centimeters of the substance to be processed are processed by applying laser once while using the mask. In the laser processing, first, an electrophotographic photosensitive member is rotated on its axis by a motor d for work rotation as illustrated in FIG. 4. While the electrophotographic photosensitive member is rotated on its axis, the position to be irradiated with laser light is shifted in the axial direction of the electrophotographic photosensitive member by a work moving device e, whereby depressed portions can be efficiently formed in the entire region of the surface of the electrophotographic photosensitive member. The depth of depressed portions can be so adjusted as to fall within a desired range depending on, for example, a period of time for which irradiation with laser light is performed and the number of times at which irradiation with laser light is performed. According to the present invention, surface-roughening processing can be achieved in which the size, shape and arrangement of depressed portions can be provided with high controllability, high accuracy and a high degree of freedom.

Figure 5:
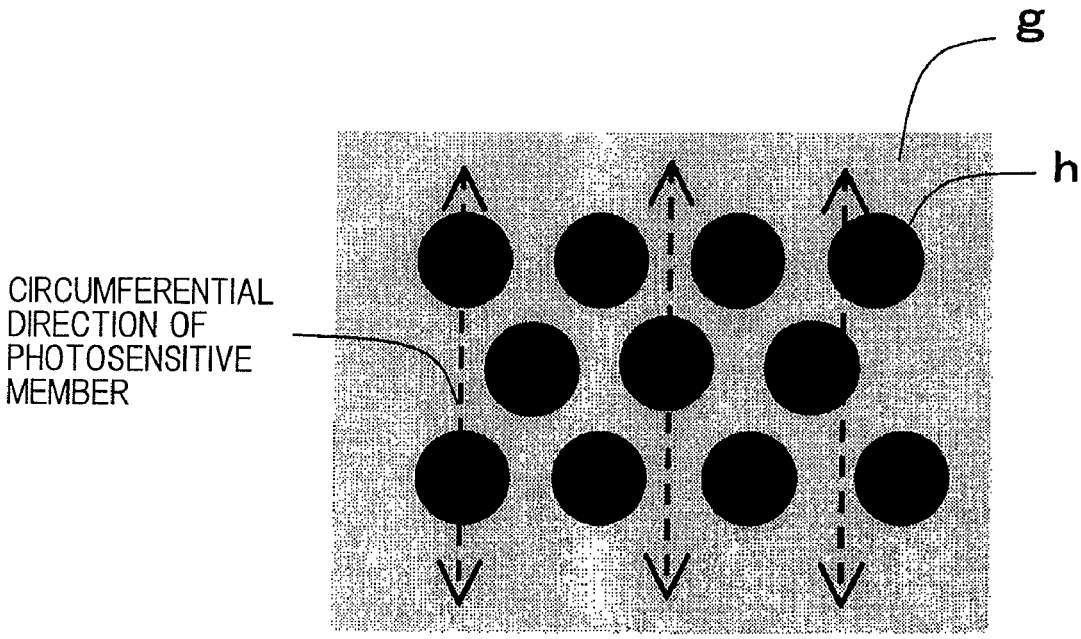
FIG. 5 is a partially enlarged view illustrating an example of the arrangement pattern of depressed portions in the surface of the electrophotographic photosensitive member of the present invention.

Alternatively, in the method of forming depressed portions on the surface of an electrophotographic photosensitive member by irradiation with laser light, the above-mentioned method of forming depressed portions may be applied to several portions or to the entire region of the surface of the photosensitive member by using the same mask pattern. The method enables depressed portions to be formed uniformly in the entirety of the surface of the photosensitive member. As a result, the mechanical load applied to a cleaning blade becomes uniform when the blade is used in an electrophotographic apparatus. In addition, the localization of the mechanical load applied to the cleaning blade can be further prevented by forming such a mask pattern as illustrated in FIG. 5 in which both depressed portions h and non-depressed portions g are so arranged as to be present on any lines in the circumferential direction of the photosensitive member.

Next, the method of forming depressed portions by bringing a mold having a predetermined shape into pressure contact with the surface of an electrophotographic photosensitive member to transfer the shape will be described.

Figure 6:
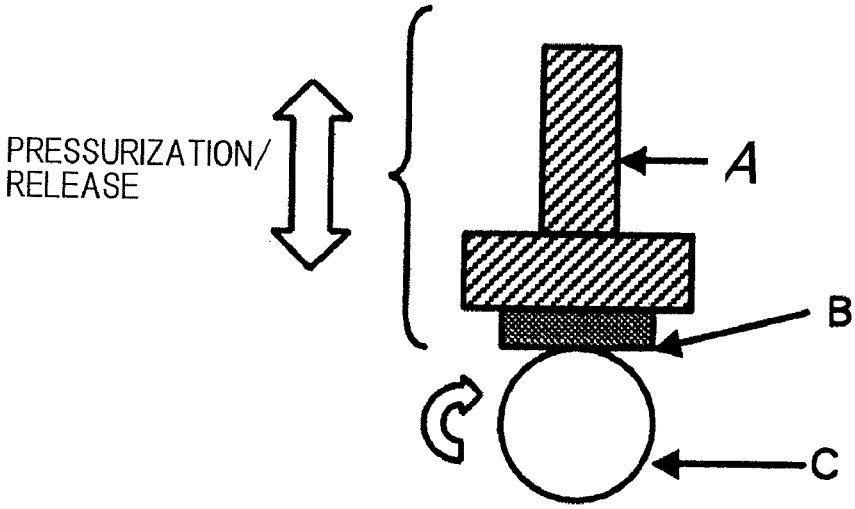
FIG. 6 is a schematic view illustrating an example of a pressure contact profile transfer processing apparatus to be used in the formation of depressed portions with a mold in the present invention.

FIG. 6 illustrates an example of a schematic view of a pressure contact profile transfer processing apparatus using a mold in the present invention. After attaching a predetermined mold B to a pressure device A capable of repeatedly performing pressurization and release, the predetermined mold B is brought into pressure contact with a photosensitive member C at a predetermined pressure so that the shape of the mold is transferred. Then, the pressure is removed once, and the photosensitive member C is rotated. After that, a pressurizing step and a profile transferring step are performed again. Predetermined depressed portions can be formed over the entire periphery of the photosensitive member by repeating the foregoing process.

Figure 7:
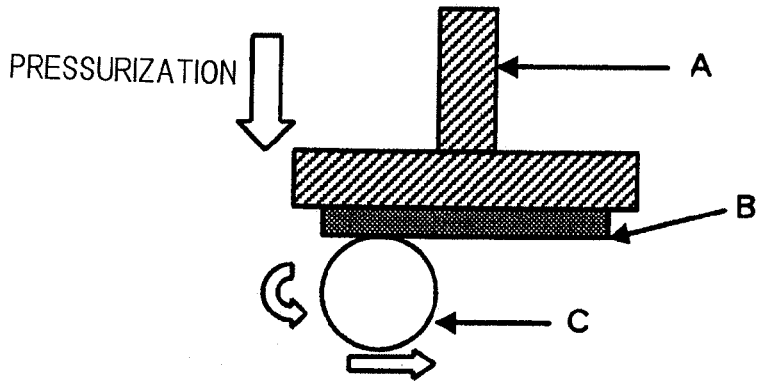
FIG. 7 is a schematic view illustrating an example of a pressure contact profile transfer processing apparatus to be used in the formation of depressed portions with a mold of the present invention.

In addition, as illustrated in FIG. 7, first, the mold B longer than the total peripheral length of the photosensitive member C is attached to the pressure device A. After that, the photosensitive member C is rotated and moved while a predetermined pressure is applied to the photosensitive member, whereby predetermined dimple shapes can be formed over the entire periphery of the photosensitive member.

Alternatively, the surface of a photosensitive member can be processed by interposing a sheet-like mold between a roll-like pressure device and the photosensitive member and feeding the mold sheet.

In addition, the mold and/or the photosensitive member may be heated in order for the shape of the mold to be efficiently transferred.

Figure 8A:
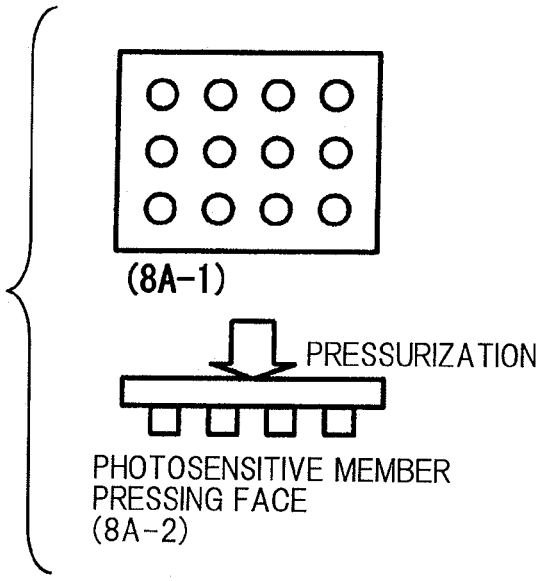
FIG. 8A are views illustrating an example of the shape of a mold to be used in the formation of depressed portions in the present invention.
Figure 8B:
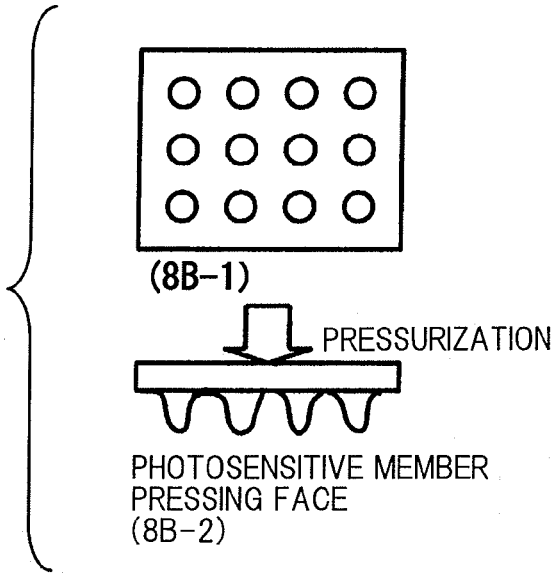
FIG. 8B are views each illustrating an example of the shape of a mold to be used in the formation of depressed portions in the present invention.

The material, size, and shape of a mold itself can be appropriately selected. Examples of the material include: a metal or a resin film subjected to fine surface processing; a material obtained by performing patterning onto the surface of a silicon wafer or the like with a resist; a resin film in which a fine particle is dispersed; and a material obtained by applying a metal coating to a resin film having a predetermined fine surface shape. FIGS. 8A and 8B illustrate an example of a mold shape. In FIGS. 8A and 8B, FIGS. 8A-1 and 8B-1 are each a view illustrating a mold viewed from its top, and FIGS. 8A-2 and 8B-2 are each a view illustrating the mold viewed from its side.

An elastic body can be placed between a mold and a pressure device for uniformizing a pressure to be applied to a photosensitive member.

Next, the method of forming depressed portions by generating condensation on the surface of the surface layer of an electrophotographic photosensitive member at the time of forming the surface layer will be described.

The method of forming depressed portions by generating condensation on the surface of the surface layer of an electrophotographic photosensitive member at the time of forming the surface layer is performed as described below. A surface layer coating liquid containing a binder resin and a specific aromatic organic solvent is prepared with the content of the aromatic organic solvent being 50 mass % or more and 80 mass % or less. Depressed portions independent of one another are formed on the surface of a support by the steps of: applying the application liquid to the support; holding the support coated with the coating liquid to generate condensation, or to condense dew, on the surface of the support coated with the application liquid; and drying the support under heat.

Examples of the above-mentioned binder resin include an acrylic resin, a styrene resin, a polyester resin, a polycarbonate resin, a polyallylate resin, a polysulfone resin, a polyphenylene oxide resin, an epoxy resin, a polyurethane resin, an alkyd resin, and an unsaturated resin. In particular, a polymethyl methacrylate resin, a polystyrene resin, a styrene-acrylonitrile copolymer resin, a polycarbonate resin, a polyallylate resin, or a diallyl phthalate resin is preferable. A polycarbonate resin or a polyallylate resin is more preferable. Any one of those resins can be used alone, or two or more of them can be used as a mixture or a copolymer.

The above-mentioned specific aromatic organic solvent is low in affinity for water. Specific examples of the solvent include 1,2-dimethylbenzene, 1,3-dimethylbenzene, 1,4-dimethylbenzene, 1,3,5-trimethylbenzene, and chlorobenzene.

It is important for the above-mentioned surface layer coating liquid to contain the aromatic organic solvent. The surface layer coating liquid may additionally contain an organic solvent having a high affinity for water or water for constantly forming depressed portions. Examples of a preferable organic solvent having a high affinity for water include (methylsulfinyl)methane (popular name: dimethyl sulfoxide), thiolane-1,1-dione (popular name: sulfolane), N,N-dimethylcarboxyamide, N,N-diethylcarboxyamide, dimethylacetamide, and 1-methylpyrrolidin-2-one. Those organic solvents can each be contained singly or in a mixture of two or more of them.

The above-mentioned step of holding the support to generate condensation on the surface of the support is a step of holding the support coated with the surface layer coating liquid for a certain period of time under an atmosphere in which condensation is generated on the surface of the support. The term "condensation" in the method refers to liquid droplets formed on the surface of the support coated with the surface layer coating liquid by the action of water. Conditions under which condensation is generated on the surface of the support are affected by the relative humidity of an atmosphere under which the support is held and conditions under which the solvent of the coating liquid vaporizes (such as heat of vaporization). However, the influence of the conditions under which the solvent of the coating liquid vaporizes is small because the aromatic organic solvent in the surface layer coating liquid for a accounts for 50 mass % or more of the total solvent mass. Therefore, the generation of condensation depends mainly on the relative humidity of the atmosphere under which the support is held. The relative humidity at which condensation is generated on the surface of the support, is 40% to 100%, preferably 70% or more. In the step of holding the support, the support is required to be held for a time period necessary for the formation of liquid droplets due to condensation, but from the viewpoint of productivity, the time period is preferably 1 second to 300 seconds, and more preferably about 10 seconds to 180 seconds. The relative humidity is important for the step of holding the support, and the ambient temperature is preferably 20° C. or higher and 80° C. or lower.

The liquid droplets condensed on the surface of the support through the step of holding the support can be formed into depressed portions on the surface of the photosensitive member through the above-mentioned step of drying the support under heat. The support is dried under heat because quick drying is important for the formation of depressed portions having high uniformity. The drying temperature in the drying step is preferably 100° C. to 150° C. The support is dried under heat for such a time period that the solvent in the coating liquid applied onto the support and the droplets formed in the condensation step are removed. A time period for the drying is preferably 20 minutes to 120 minutes, more preferably 40 minutes to 100 minutes.

Depressed portions independent of one another are formed on the surface of the electrophotographic photosensitive member by the above-mentioned method of forming depressed portions involving generating condensation on the surface of the surface layer of the photosensitive member at the time of the formation of the surface layer. The method involves forming liquid droplets formed by the action of water into depressed portions by using a solvent having a low affinity for water and a binder resin. Depressed portions formed on the surface of the electrophotographic photosensitive member by the method have high uniformity because each of the depressed portions is shaped by cohesive force of water. In addition, the method is a production method involving a step of removing liquid droplets or liquid droplets in a sufficiently grown state, and hence, for example, droplet-shaped or honeycomb-shaped (hexagonal) depressed portions are formed on the surface of the electrophotographic photosensitive member. The term "droplet-shaped depressed portion" refers to a depressed portion which is of, for example, a circular shape or an elliptical shape when the surface of the photosensitive member is observed and which is of, for example, a partially circular shape or a partially elliptical shape when the section of the photosensitive member is observed. In addition, the term "honeycomb-shaped (hexagonal) depressed portion" refers to, for example, a depressed portion formed by the closest packing of liquid droplets on the surface of the electrophotographic photosensitive member. To be specific, the term "honeycomb-shaped (hexagonal) depressed portion" refers to a depressed portion which is of, for example, a circular shape, a hexagonal shape, or a rounded hexagonal shape when the surface of the photosensitive member is observed and which is of, for example, a partially circular shape or a prismatic shape when the section of the photosensitive member is observed.

In the present invention, in order to form desired depressed portions, the formation of depressed portions can be controlled according to: the type and content of solvent in the surface layer coating liquid; the relative humidity and a time period for which the support is held, in the step of holding the support; and the temperature at which the support is dried under heating in the drying step.

<Electrophotographic Photosensitive Member According to the Present Invention>

As described above, the electrophotographic photosensitive member of the present invention has a support and an organic photosensitive layer (hereinafter simply referred to also as "photosensitive layer") provided on the support. Although, in general, a cylindrical organic electrophotographic photosensitive member obtained by forming a photosensitive layer on a cylindrical support is widely used, the electrophotographic photosensitive member according to the present invention may be of a belt-like shape or a sheet-like shape.

The photosensitive layer may be a single-layered type photosensitive layer containing a charge transport material and a charge generation material in the same layer or a layered type (separated-function type) photosensitive layer having a charge generating layer containing a charge generation material and a charge transporting layer containing a charge transport material separately. For the electrophotographic photosensitive member according to the present invention, the layered type photosensitive layer is preferred in view of electrophotographic characteristics. Further, the layered type photosensitive layer may be a regular type photosensitive layer having a charge generating layer and a charge transporting layer in this order superposed on a support or a reverse type photosensitive layer having a charge transporting layer and a charge generating layer in this order superposed on a support. When the layered type photosensitive layer is employed in the electrophotographic photosensitive member according to the present invention, the charge generating layer may have a layered structure, or the charge transporting layer may have a layered structure. Further, a protective layer can be formed on the photosensitive layer for improving the durability of the electrophotographic photosensitive member.

A material for the support is required to have conductivity (conductive support). As examples of such a support, the following may be cited: a support made of a metal (alloy) such as iron, copper, gold, silver, aluminum, zinc, titanium, lead, nickel, tin, antimony, indium, chromium, an aluminum alloy, or stainless steel.

In addition, it is possible to use the above-mentioned support made of a metal or a support made of a plastic, having a layer coated with a film formed by vacuum deposition of aluminum, an aluminum alloy, or an indium oxide-tin oxide alloy. A support obtained by impregnating a plastic or paper with a conductive particle such as carbon black, tin oxide particles, titanium oxide particles, or silver particles together with a proper binder resin, or a support made of a plastic having a conductive binder resin can also be used.

The surface of the support may be subjected to cutting, surface-roughening or alumite treatment for preventing interference fringe due to scattering of laser light.

A conductive layer may be provided between the support and an intermediate layer to be described later or the photosensitive layer (including the charge generating layer and the charge transporting layer) for preventing interference fringe due to scattering of laser light or for covering flaws on the support.

The conductive layer may be formed by using a conductive layer coating liquid prepared by dispersing and/or dissolving carbon black, a conductive pigment, or a resistance adjusting pigment in a binder resin. A compound that undergoes curing polymerization by heating or irradiation with radiation may be added to the conductive layer coating liquid. The surface of a conductive layer in which a conductive pigment or a resistance adjusting pigment is dispersed tends to be roughened.

The conductive layer has a thickness of preferably 0.2 μm or more and 40 μm or less, more preferably 1 μm or more and 35 μm or less, or still more preferably 5 μm or more and 30 μm or less.

Examples of the binder resin to be used in the conductive layer include: polymers and copolymers of vinyl compounds such as styrene, vinyl acetate, vinyl chloride, an acrylate, a methacrylate, vinylidene fluoride, and trifluoroethylene; polyvinyl alcohol; polyvinyl acetal; polycarbonate; polyester; polysulfone; polyphenylene oxide; polyurethane; a cellulose resin; a phenol resin; a melamine resin; a silicone resin; and an epoxy resin.

Examples of the conductive pigment and the resistance adjusting pigment include: particles of metals (alloys) such as aluminum, zinc, copper, chromium, nickel, silver, and stainless steel; and materials obtained by vacuum-depositing these metals onto the surfaces of plastic particles. Particles of metal oxides such as zinc oxide, titanium oxide, tin oxide, antimony oxide, indium oxide, bismuth oxide, indium oxide doped with tin, and tin oxide doped with antimony or tantalum are also be used. One type of those particles may be used alone, or two or more types of them may be used in combination. When two or more types of those particles are used in combination, they may be merely mixed, or may be in the form of solid solution or fusion.

An intermediate layer having a barrier function or an adhesion function may be provided between the support and the conductive layer or the photosensitive layer (including the charge generating layer and the charge transporting layer). The intermediate layer is formed for: improving the adhesiveness and coating properties of the photosensitive layer; improving properties of injecting charges from the support; and protecting the photosensitive layer against electrical breakage.

Examples of a material for the intermediate layer include polyvinyl alcohol, poly-N-vinylimidazole, polyethylene oxide, ethylcellulose, an ethylene-acrylic acid copolymer, casein, polyamide, N-methoxymethylated 6 nylon, copolymerized nylon, glue, and gelatin. The intermediate layer can be formed by: applying an intermediate layer coating liquid prepared by dissolving any one of those materials into a solvent; and drying the applied liquid.

The intermediate layer has a thickness of preferably 0.05 μm or more and 7 μm or less, and more preferably 0.1 μm or more and 2 μm or less.

Examples of the charge generating substance to be used in the photosensitive layer in the present invention include: pyrylium; thiapyrylium-type dyes; phthalocyanine pigments having various central metals and various crystal systems (such as α, β, γ, ϵ, and X types); anthanthrone pigments; dibenzpyrenequinone pigments; pyranthrone pigments; azo pigments such as monoazo, disazo, and trisazo pigments; indigo pigments; quinacridone pigments; asymmetric quinocyanine pigments; quinocyanine pigments; and amorphous silicon. One type of those charge generating substances may be used alone, or two or more types of them may be used in combination.

Examples of the charge transporting substance to be used in the electrophotographic photosensitive member of the present invention include: pyrene compounds; N-alkylcarbazole compounds; hydrazone compounds; N,N-dialkylaniline compounds; diphenylamine compounds; triphenylamine compounds; triphenylmethane compounds; pyrazoline compounds; styryl compounds; and stilbene compounds.

In a case where the photosensitive layer is functionally separated into a charge generating layer and a charge transporting layer, the charge generating layer may be formed by the following method. First, the charge generation material is dispersed together with 0.3 to 4-fold mass of a binder resin and a solvent by means of a homogenizer, an ultrasonic disperser, a ball mill, a vibrating ball mill, a sand mill, an attritor, or a roll mill. A charge generating layer coating liquid thus prepared is applied. The applied liquid is dried, whereby the charge generating layer can be formed. Alternatively, the charge generating layer may be formed by vacuum deposition of the charge generating substance.

The charge transporting layer can be formed by: applying a charge transporting layer coating liquid prepared by dissolving a charge transporting substance and a binder resin in a solvent; and drying the applied liquid. Alternatively, among the above-mentioned charge transporting substances, a substance which has film-forming properties in itself can be formed by itself into the charge transporting layer without using any binder resin.

Examples of the binder resin to be used in each of the charge generating layer and the charge transporting layer include: polymers and copolymers of vinyl compounds such as styrene, vinyl acetate, vinyl chloride, an acrylate, a methacrylate, vinylidene fluoride, and trifluoroethylene; polyvinyl alcohol; polyvinyl acetal; polycarbonate; polyester; polysulfone; polyphenylene oxide; polyurethane; a cellulose resin; a phenol resin; a melamine resin; a silicone resin; and an epoxy resin.

The charge generating layer has a thickness of preferably 5 μm or less, and more preferably 0.1 μm or more and 2 μm or less.

The charge transporting layer has a thickness of preferably 5 μm or more and 50 μm or less, or more preferably 10 μm or more to 35 μm or less.

For the purpose of improving durability that is one of the properties required for the electrophotographic photosensitive member, in the case of the above-mentioned separated-function type photosensitive layer, the material designing for the charge transporting layer as a surface layer is important. Examples of the designing include: the use of a binder resin having high strength; the control of a ratio between a charge transporting substance showing plasticity and a binder resin; and the use of a polymeric charge transporting substance. It is effective to form the surface layer from a curable resin in order to achieve higher durability.

In the present invention, the charge transporting layer itself may be formed of a curable resin. In addition, a curable resin layer as a second charge transporting layer or as a protective layer can be formed on the above-mentioned charge transporting layer. The compatibility between film strength and charge transporting ability is a characteristic required for the curable resin layer, and hence the layer is generally formed of a charge transporting material and a polymerizable or crosslinkable monomer or oligomer. In some cases, conductive fine particles the resistance of which is controlled can also be utilized for imparting charge transporting ability.

Any one of known hole transportable compounds and electron transportable compounds can be used as the charge transporting material. Examples of the polymerizable or crosslinkable monomer or oligomer include: a chain polymerization type material having an acryloyloxy group or a styrene group; and a successive polymerization type material having a hydroxyl group, an alkoxysilyl group, or an isocyanate group. From the viewpoints of electrophotographic characteristics to be obtained, general-purpose properties, material designing and production stability, a combination of a hole transportable compound and a chain polymerization type material is preferable, and furthermore, a system for curing a compound having in its molecule both a hole transportable group and an acryloyloxy group is particularly preferable.

Any known means utilizing heat, light or radiation can be used as curing means.

The curable resin layer has a thickness of preferably 5 μm or more and 50 μm or less, and more preferably 10 μm or more and 35 μm or less, as in the foregoing when the layer is the charge transporting layer. The layer has a thickness of preferably 0.1 μm or more and 20 μm or less, and more preferably 1 μm or more and 10 μm or less when the layer is the second charge transporting layer or the protective layer.

Various additives may be added to each layer of the electrophotographic photosensitive member of the present invention. Examples of the additives include: anti-degradation agents such as an antioxidant and a UV absorber; organic resin particles such as fluorine atom-containing resin particles and acrylic resin particles; and inorganic particles made of silica, titanium oxide, alumina, etc.

In the present invention, desired depressed portions can be formed by subjecting an electrophotographic photosensitive member having a surface layer produced by the above-mentioned method to the above-mentioned laser processing or the above-mentioned pressure contact profile transfer processing using a mold. In addition, when the method of forming depressed portions by generating condensation on the surface of the surface layer at the time of the formation of the surface layer is employed, desired depressed portions can be formed by controlling a method of producing the surface layer as described above.

As described above, the electrophotographic photosensitive member according to the present invention has specific depressed portions on its surface. The surface profile acts most effectively when an electrophotographic photosensitive member the surface of which is difficult to abrade is employed. This is because, as described above, an electrophotographic photosensitive member the surface of which is difficult to abrade has high durability, but involves the remarkable emergence of problems concerning, for example, cleaning performance and various image defects.

The electrophotographic photosensitive member the surface of which is difficult to abrade according to the present invention is such that the surface has an elastic deformation rate of preferably 40% or more, more preferably 45% or more, or still more preferably 50% or more. When the elastic deformation rate is less than 40%, the surface tends to be abraded.

In addition, the surface of the electrophotographic photosensitive member according to the present invention has a universal hardness value (HU) of preferably 150 $N/mm^2$ or more.

When the elastic deformation rate is less than 40%, or the universal hardness value is less than 150 $N/mm^2$, the surface tends to be abraded.

As described above, the electrophotographic photosensitive member the surface of which hardly wears shows an extremely small, or no, change in the above-mentioned fine surface profile over from the initial stage until after being repeatedly used, and hence can maintain its initial performance favorably even after being repeatedly used for a long period of time.

In the present invention, the universal hardness value (HU) and elastic deformation rate of the surface of the electrophotographic photosensitive member are values measured with a microhardness measuring device FISCHERSCOPE H100V (manufactured by Fischer Technology, Inc.) in an environment having a temperature of 25° C. and a humidity of 50% RH. The FISCHERSCOPE H100V is a device capable of determining a continuous hardness by: bringing an indenter into contact with an object to be measured (the peripheral surface of the electrophotographic photosensitive member); continuously applying a load to the indenter; and directly reading an indentation depth under the load.

In the present invention, a Vickers pyramid diamond indenter having an angle between the opposite faces of 136° was used as an indenter, and the above-mentioned values were measured by pressing the indenter against the peripheral surface of the electrophotographic photosensitive member under the following conditions.

The final value for a load to be continuously applied to the indenter (final load): 6 mN A period of time for which a state that the final load of 6 mN is applied to the indenter is retained (retention time): 0.1 sec In addition, the number of points to be measured was 273.

Figure 9:
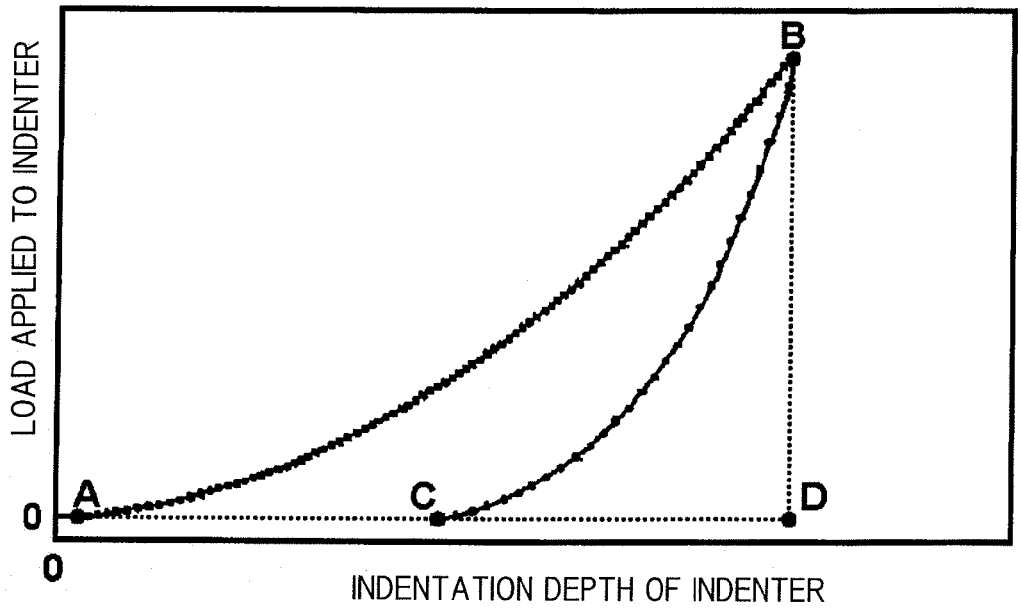
FIG. 9 is a graph showing the outline of an output chart of FISCHERSCOPE H100V (manufactured by Fischer Technology, Inc.).
Figure 10:
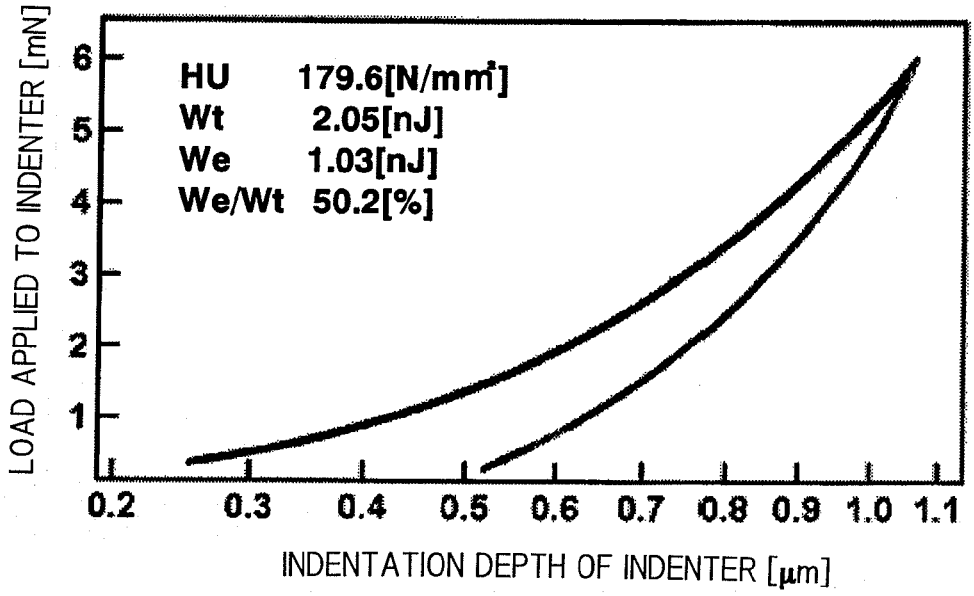
FIG. 10 is a graph showing an example of an output chart of FISCHERSCOPE H100V (manufactured by Fischer Technology, Inc.).

FIG. 9 is a graph showing the outline of the output chart of a FISCHERSCOPE H100V (manufactured by Fischer Technology, Inc.). In addition, FIG. 10 is a graph showing an example of the output chart of the FISCHERSCOPE H100V (manufactured by Fischer Technology, Inc.). In each of FIGS. 9 and 10, the axis of ordinate indicates a load F (mN) applied to an indenter, and the axis of abscissa indicates an indentation depth h (μm) of the indenter. FIG. 9 illustrates a result in the case where the load to be applied to the indenter is increased in a stepwise fashion to reach the maximum (A→B), and is then reduced in a stepwise fashion (B→C). FIG. 10 illustrates a result in the case where the load to be applied to the indenter is increased in a stepwise fashion to be finally 6 mN, and is then reduced in a stepwise fashion.

The universal hardness value (HU) can be determined from the following expression by using the indentation depth of the indenter when the final load of 6 mN is applied to the indenter. In the following expression, HU represents a universal hardness (HU), $F_f$ represents the final load, $S_f$ represents the surface area of the indented part of the indenter when the final load is applied, and $h_f$ represents the indentation depth (mm) of the indenter when the final load is applied.

$$HU = \frac{F_f[N]}{S_f[\mathrm{mm}^2]} = \frac{6\times10^{-3}}{26.43\times(h_f\times10^{-3})^2}$$

In addition, the elastic deformation rate can be determined from a change in work done (energy) by the indenter against the object to be measured (the peripheral surface of the electrophotographic photosensitive member), that is, a change in energy due to an increase or decrease in load applied by the indenter to the object to be measured (the peripheral surface of the electrophotographic photosensitive member). To be specific, a value obtained by dividing elastic deformation work done We by a total work done Wt (We/Wt) is the elastic deformation rate. The total work done Wt corresponds to the area of a region surrounded by lines A-B-D-A in FIG. 9, and the elastic deformation work done We corresponds to the area of a region surrounded by lines C-B-D-C in FIG. 9.

<Process Cartridge and Electrophotographic Apparatus>

Figure 11:
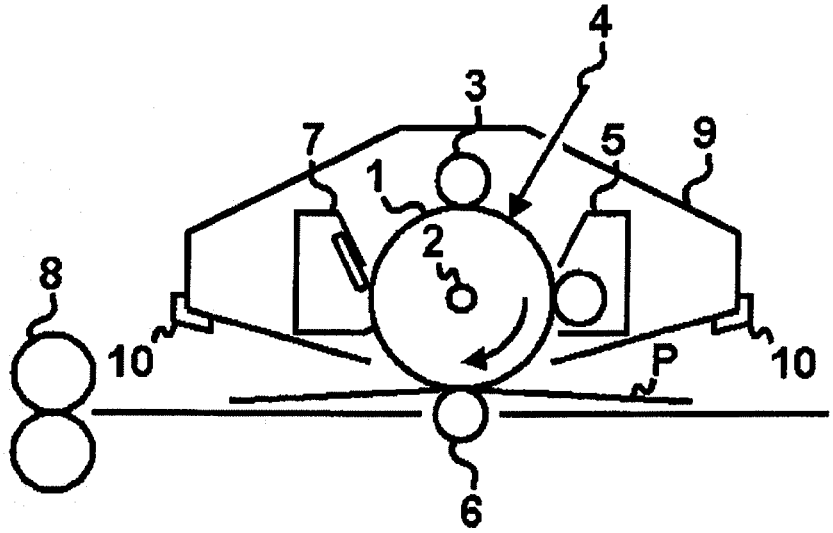
FIG. 11 is a view illustrating an example of the schematic constitution of an electrophotographic apparatus provided with a process cartridge having the electrophotographic photosensitive member of the present invention.

FIG. 11 is a view illustrating an example of the schematic constitution of an electrophotographic apparatus provided with a process cartridge having the electrophotographic photosensitive member of the present invention.

In FIG. 11, a cylindrical electrophotographic photosensitive member 1 is rotated around an axis 2 in the direction indicated by an arrow at a predetermined peripheral speed.

The peripheral surface of the electrophotographic photosensitive member 1 being rotated is uniformly charged to a predetermined, positive or negative potential by a charging device (primary charging device: a charging roller or the like) 3. Next, the peripheral surface receives exposure light (image exposure light) 4 output from an exposing device (not shown) such as slit exposure or laser beam scanning exposure. Thus, electrostatic latent images corresponding to target images are sequentially formed on the peripheral surface of the electrophotographic photosensitive member 1. It should be noted that the charging device 3 is not limited to such a contact charging device using a charging roller as illustrated in FIG. 11, and may be a corona charging device using a corona charger, or a charging device according to any other system.

The electrostatic latent images formed on the peripheral surface of the electrophotographic photosensitive member 1 are developed with toner from a developing device 5 to be toner images. Next, the toner images formed and carried on the peripheral surface of the electrophotographic photosensitive member 1 are sequentially transferred onto a transfer material (such as plain paper or coated paper) P by a transferring bias from a transferring device (such as a transferring roller) 6. It should be noted that the transfer material P may be fed from a transfer material feeding device (not shown) into a portion (contact portion) between the electrophotographic photosensitive member 1 and the transferring device 6 in synchronization with the rotation of the electrophotographic photosensitive member 1. Alternatively, the following system is also possible: a toner image is temporarily transferred onto an intermediate transfer material or an intermediate transfer belt instead of a transfer material, and is then transferred onto the transfer material.

The transfer material P on which the toner images have been transferred is separated from the peripheral surface of the electrophotographic photosensitive member 1 and introduced into a fixing device 8 where the images are fixed. As a result, the material is discharged as an image formed matter (print or copy) out of the apparatus.

Transfer residual toner on the peripheral surface of the electrophotographic photosensitive member 1 after the transfer of the toner images is removed by a cleaning device (such as a cleaning blade) 7 so that the peripheral surface is cleaned. Further, the peripheral surface is de-charged by pre-exposure light (not shown) from a pre-exposing device (not shown), and is then repeatedly used for image formation. The electrophotographic photosensitive member according to the present invention is useful also for a cleaning-less system using no cleaning blade.

It should be noted that the case where the charging device 3 is a contact charging device using a charging roller as illustrated in FIG. 11 does not necessarily need pre-exposure.

Two or more of the above-mentioned constituents, i.e., the electrophotographic photosensitive member 1, the charging device 3, the developing device 5, the transferring device 6, and the cleaning device 7 may be held in a container and integrally combined together to constitute a process cartridge. The process cartridge may be constituted so as to be freely detachable and mountable to the main body of an electrophotographic apparatus in a copying machine or in a laser beam printer. In FIG. 11, the electrophotographic photosensitive member 1, the charging device 3, the developing device 5, and the cleaning device 7 are integrally supported to form a process cartridge 9 which is freely detachable and mountable to the main body of the electrophotographic apparatus by using a guiding device 10 such as a rail set in the main body of the electrophotographic apparatus.

EXAMPLE

Hereinafter, the present invention will be described in more detail by way of specific examples. The term "part(s)" in the following examples refers to "part(s) by mass".

Example A-1

An aluminum cylinder having a diameter of 30 mm and a length of 357.5 mm was used as a support (cylindrical support).

Next, a solution including the following components was dispersed with a ball mill for about 20 hours, whereby a conductive layer coating liquid was prepared.

| | |
|---|---|
| Powder composed of barium sulfate particles each having a tin oxide coating layer (trade name: Pastran PC1, manufactured by MITSUI MINING & SMELTING CO., LTD.) | 60 parts |
| Titanium oxide (trade name: TITANIX JR, manufactured by TAYCA CORPORATION) | 15 parts |
| Resol type phenol resin (trade name: PHENOLITE J-325, manufactured by DAINIPPON INK AND CHEMICALS; solid content: 70 mass %) | 43 parts |
| Silicone oil (trade name: SH 28 PA, manufactured by Dow Corning Toray Silicone Co., Ltd.) | 0.015 parts |
| Silicone resin (trade name: Tospearl 120, manufactured by Momentive Performance Materials Inc.) | 3.6 parts |
| 2-methoxy-1-propanol | 50 parts |
| Methanol | 50 parts |

The conductive layer coating liquid thus prepared was applied onto the aluminum cylinder by a dip coating method, and was cured under heating in an oven at a temperature of 140° C. for 1 hour, whereby a resin layer having a thickness of 15 μm was formed.

Next, a solution prepared by dissolving the following components in the mixed liquid of 400 parts of methanol and 200 parts of n-butanol was applied on the above-mentioned resin layer by dip coating and was dried under heating in an oven at a temperature of 100° C. for 30 minutes, whereby an intermediate layer having a thickness of 0.45 μm was formed.

| | |
|---|---|
| Copolymer nylon resin (trade name: Amilan CM8000, manufactured by Toray Industries, Inc.) | 10 parts |
| Methoxymethylated 6 nylon resin (trade name: Toresin EF-30T, manufactured by Nagase ChemteX Corporation) | 30 parts |

Next, the following components were dispersed with a sand mill device using glass beads each having a diameter of 1 mm for 4 hours. After that, 700 parts of ethyl acetate were added to the resultant, whereby a charge generating layer coating dispersion liquid was prepared.

| | |
|---|---|
| Hole transportable compound represented by the following structural formula (2) | 70 parts |

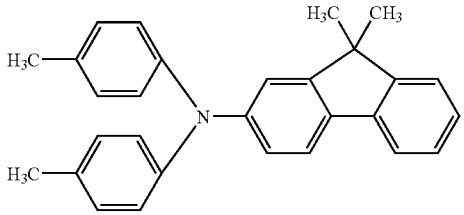

| | |
|---|---|
| Polycarbonate resin (trade name: IUPILON Z400, manufactured by Mitsubishi Engineering-Plastics Corporation) | 100 parts |

Next, the following component was dissolved as a dispersant in the mixed solvent of 20 parts of 1,1,2,2,3,3,4-heptafluorocyclopentane (trade name: ZEORORA H, manufactured by ZEON CORPORATION) and 20 parts of 1-propanol.

Fluorine atom-containing resin (trade name: GF-300, manufactured by TOAGOSEI CO., LTD.) 0.5 part

| | |
|---|---|
| Hydroxygallium phthalocyanine (having strong peaks at Bragg angles 2θ ± 0.2° of 7.4° and 28.2° in CuKα characteristic X-ray diffraction) | 20 parts |
| Calixarene compound represented by the following structural formula (1) | 0.2 part |

(1)

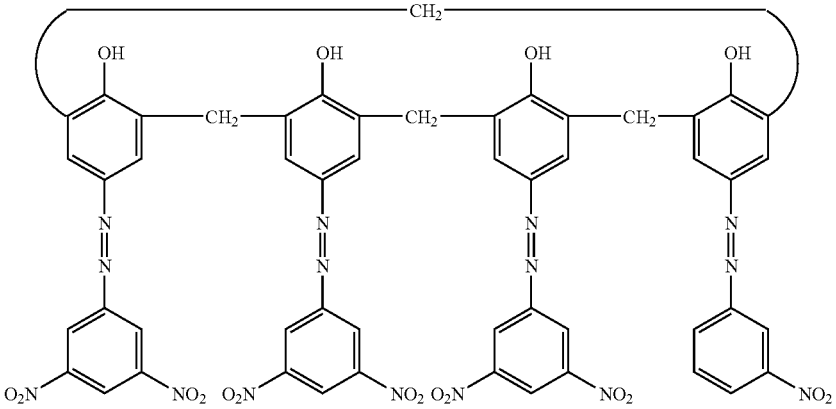

| | |
|---|---|
| Polyvinyl butyral (trade name: S-LEC BX-1, manufactured by SEKISUI CHEMICAL CO., LTD.) | 10 parts |
| Cyclohexanone | 600 parts |

The dispersion liquid was applied by a dip coating method, and was dried under heating in an oven at a temperature of 80° C. for 15 minutes, whereby a charge generating layer having a thickness of 0.170 μm was formed.

Next, a charge transporting layer coating liquid was prepared by dissolving the following components in a mixed solvent of 600 parts of monochlorobenzene and 200 parts of methylal. This coating liquid was applied on the charge generating layer by dip coating and was dried under heating in an oven at a temperature of 100° C. for 30 minutes, whereby a charge transporting layer having a thickness of 15 μm was formed.

10 parts of a tetrafluoroethylene resin powder (trade name: Rubron L-2, manufactured by DAIKIN INDUSTRIES, ltd.) was added as a lubricant to the resultant solution. After that, the resultant product was processed four times with a high-pressure dispersing machine (trade name: Microfluidizer M-110EH, manufactured by Microfluidics) at a pressure of 600 kgf/cm$^2$ to be uniformly dispersed. Further, the resultant dispersion was filtrated through a Polyflon filter (trade name PF-040, manufactured by ADVANTEC), whereby a lubricant-dispersed liquid was prepared. After that, 90 parts of a hole transportable compound represented by the following formula (3), 70 parts of 1,1,2,2,3,3,4-heptafluorocyclopentane and 70 parts of 1-propanol were added to the lubricant-dispersed liquid. The resultant product was filtrated through a Polyflon filter (trade name: PF-020, manufactured by ADVANTEC), whereby a second charge transporting layer coating liquid was prepared.

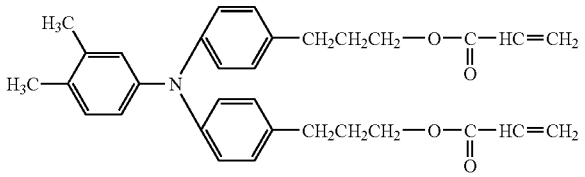

The second charge transporting layer coating liquid was applied onto the charge transporting layer, and was then dried in an oven at a temperature of 50° C. for 10 minutes in the atmosphere. After that, the resultant product was irradiated with electron beams for 1.6 seconds in nitrogen under conditions of an accelerating voltage of 150 kV and a beam current of 3.0 mA while the cylinder was rotated at 200 rpm. Subsequently, the temperature was raised from 25° C. to 125° C. over 30 seconds to carry out curing reaction. In this case, the absorbed dose of the electron beams was measured and found to be 15 kGy. In addition, the oxygen concentration in the atmosphere in which irradiation with electron beams and heat curing reaction were carried out was 15 ppm or less. The resultant product was naturally cooled to a temperature of 25° C. in the atmosphere, and then subjected to post-heating treatment in an oven at a temperature of 100° C. for 30 minutes in the atmosphere so that a protective layer (second charge transporting layer) having a thickness of 5 μm was formed. As a result, an electrophotographic photosensitive member was obtained.

<Formation of Depressed Portions by Mold Pressing Profile Transfer>

Figure 12:
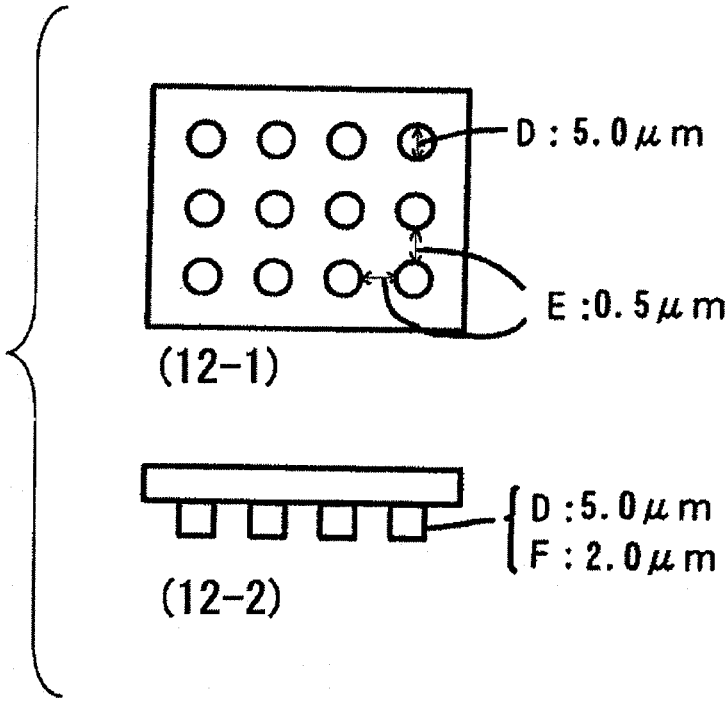
FIG. 12 are views each illustrating the shape of a mold used in Example A-1.

The electrophotographic photosensitive member was subjected to surface processing with an apparatus having a constitution illustrated in FIG. 7 in which a mold for profile transfer illustrated in FIG. 12 (where cylindrical shapes each having a major axis diameter D of 5.0 μm and a height F of 2.0 μm were arranged at intervals E of 0.5 μm) was fitted. In FIG. 12, FIG. 12-1 illustrates the shape of the mold viewed from its top, and FIG. 12-2 illustrates the shape of the mold viewed from its side. The temperature of the electrophotographic photosensitive member and the mold was controlled so that the temperature of the surface of the electrophotographic photosensitive member at the time of the processing would be 110° C., and profile transfer was performed by rotating the photosensitive member in its circumferential direction while a pressure of 3.0 MPa was applied.

<Observation of Depressed Portions Formed>

Figure 13:
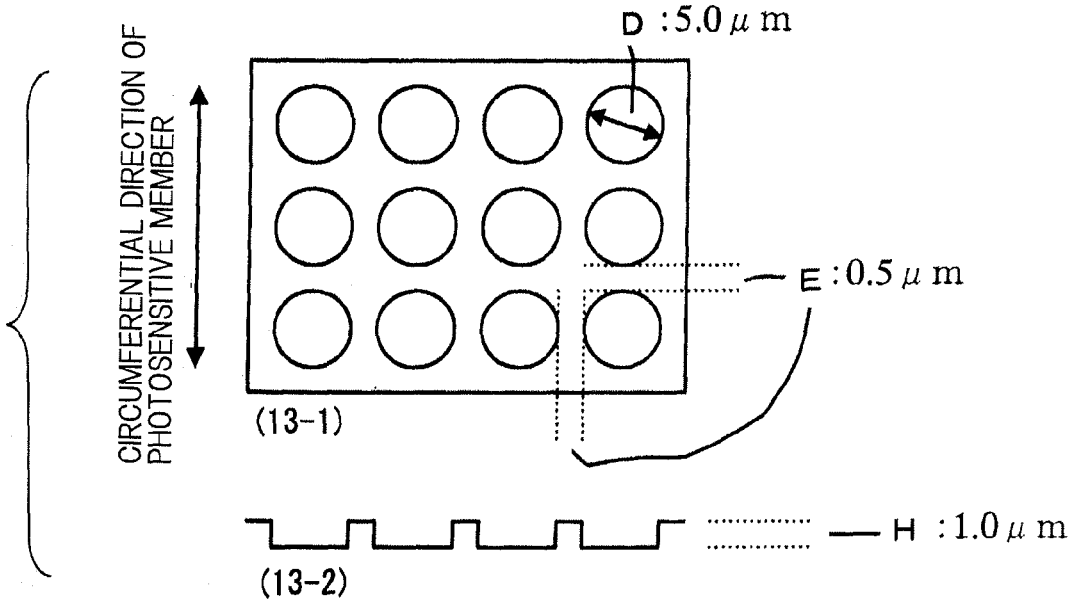
FIG. 13 are partially enlarged views each illustrating the arrangement pattern of depressed portions on the surface of an electrophotographic photosensitive member obtained in Example A-1.

The surface profile of the resultant electrophotographic photosensitive member was observed under magnification with a laser microscope (VK-9500 manufactured by KEYENCE CORPORATION). As a result, it was found that cylindrical depressed portions each having a major axis diameter D of 5.0 μm and a depth H of 1.0 μm were formed at intervals E of 0.5 μm as illustrated in FIG. 13. In FIG. 13, FIG. 13-1 illustrates a state in which the depressed portions are arranged on the surface of the photosensitive member, and FIG. 13-2 illustrates the sectional shape of the surface of the photosensitive member having depressed portions. The average major axis diameter, average depth, number, and area ratio of depressed portions per 100 μm square were as shown in Table 1.

<Measurement of Elastic Deformation Rate and Universal Hardness (HU)>

The resultant electrophotographic photosensitive member was left standing in an environment having a temperature of 23° C. and a humidity of 50% RH for 24 hours. After that, the elastic deformation rate and universal hardness (HU) of the member were measured. As a result, the value of the elastic deformation rate was 55%, and the value of the universal hardness value (HU) 180 N/mm$^2$.

<Evaluation of Electrophotographic Photosensitive Member in Practical Operation>

The electrophotographic photosensitive member obtained as described above was mounted on a modified device of an electrophotographic copying machine GP-40 manufactured by Canon Inc., and was tested and evaluated as described below.

First, conditions for a potential were set so that the dark potential (Vd) and light potential (Vl) of the electrophotographic photosensitive member in an environment having a temperature of 30° C. and a humidity of 80% RH were −700 V and −200 V, respectively, and the initial potential of the electrophotographic photosensitive member was adjusted.

Next, a cleaning blade made of polyurethane rubber was set to be at a contact angle of 26° and a contact pressure of 30 g/cm$^2$ with respect to the surface of the electrophotographic photosensitive member.

After that, a durability test was performed in which 50,000 sheets of A4 size paper were printed in a 10-sheet intermittent mode. A test chart having a printing ratio of 5% was used only for the first sheet of the 10 sheets, and a solid white image was used for the other nine sheets. After the completion of the durability test, solid white, solid black, and half tone test images were output, and image defects due to toner melt adhesion were observed. Further, the surface of the electrophotographic photosensitive member was observed with a microscope, and was evaluated on the basis of the following criteria.

A: No image defects due to toner melt adhesion are observed on any images, and no toner melt adhesion occurs on the surface of the electrophotographic photosensitive member.

B: No image defects due to toner melt adhesion are observed on any images, but extremely slight toner melt adhesion occurs on part of the surface of the electrophotographic photosensitive member.

C: No image defects due to toner melt adhesion are observed on solid white images, but extremely slight image defects due to toner melt adhesion are observed on half tone images and solid black images, and slight toner melt adhesion occurs on the entire surface of the electrophotographic photosensitive member.

D: Image defects due to toner melt adhesion occur on any images, and remarkable toner melt adhesion occurs on the entire surface of the electrophotographic photosensitive member.

Further, the cleaning blade edge on the downstream side in the rotation direction of the electrophotographic photosensitive member after the durability test was observed, and evaluation was made on a state in which toner escaped owing to cleaning failure on the basis of the following criteria.

A: No escape of toner occurs.

B: The extremely slight escape of toner occurs in part of the longitudinal direction of the electrophotographic photosensitive member.

C: The escape of toner occurs over the entire region in the longitudinal direction of the electrophotographic photosensitive member.

As a result, no image failure due to toner melt adhesion was observed on any test image, and no toner melt adhesion was observed in the observation of the surface of the electrophotographic photosensitive member with a microscope. Further, no escape of toner due to cleaning failure was observed.

Example A-2

An electrophotographic photosensitive member was produced in the same manner as in Example A-1.

<Formation of Depressed Portions by Mold Pressing Profile Transfer>

Figure 14:
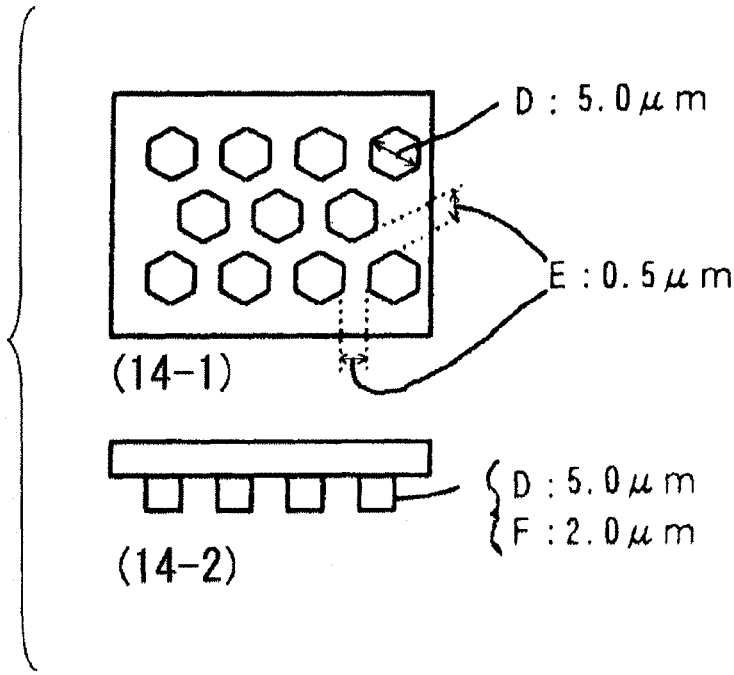
FIG. 14 are views illustrating the shape of a mold used in Example A-2.

Processing was performed in the same manner as in Example A-1 except that the mold used in Example A-1 was changed to a mold for profile transfer illustrated in FIG. 14 (in which hexagonal columnar shapes each having a major axis diameter D of 5.0 μm and a height F of 2.0 μm were arranged at intervals E of 0.5 μm). In FIG. 14, FIG. 14-1 illustrates the shape of the mold viewed from its top, and FIG. 14-2 illustrates the shape of the mold viewed from its side.

<Observation of Depressed Portions Formed>

Figure 15:
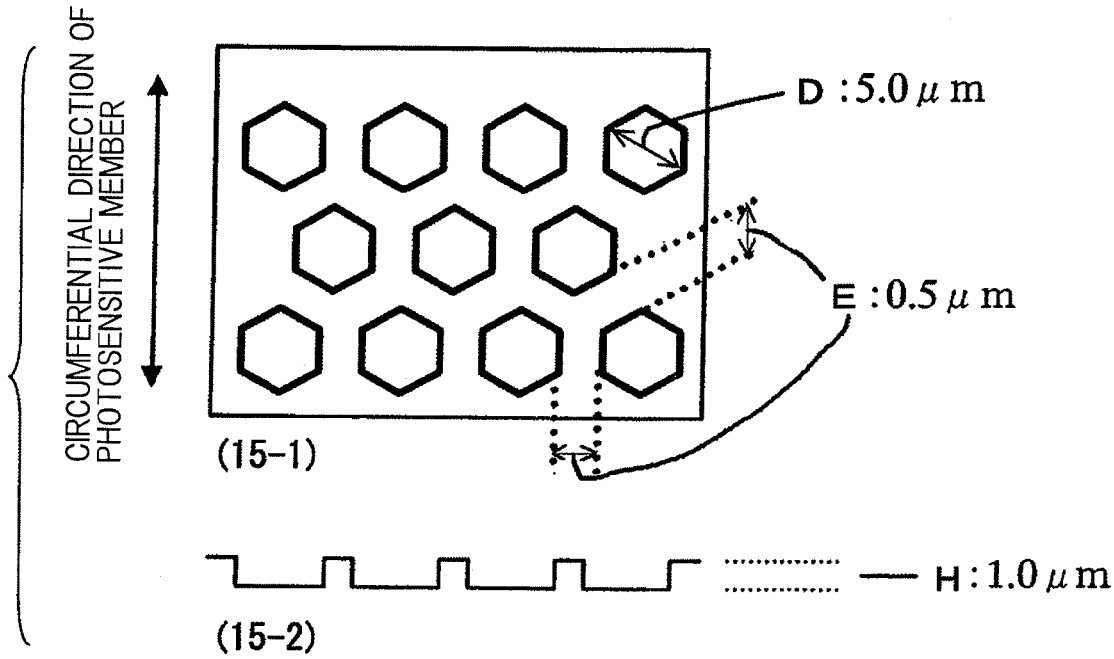
FIG. 15 are partially enlarged views illustrating the arrangement pattern of depressed portions on the surface of an electrophotographic photosensitive member obtained in Example A-2.

The surface shape of the resultant electrophotographic photosensitive member was observed under magnification with a laser microscope (VK-9500 manufactured by KEYENCE CORPORATION). As a result, it was found that hexagonal columnar depressed portions each having a major axis diameter D of 5.0 μm and a depth H of 1.0 μm were formed at intervals E of 0.5 μm as illustrated in FIG. 15. In FIG. 15, FIG. 15-1 illustrates a state in which the depressed portions are arranged on the surface of the photosensitive member, and FIG. 15-2 illustrates the sectional shape of the surface of the photosensitive member having depressed portions. The average major axis diameter, average depth, number, and area ratio of depressed portions per 100 μm square were as shown in Table 1.

The resultant photosensitive member was evaluated for other items in the same manner as in Example A-1. Table 1 shows the results. Values of the elastic deformation rate and universal hardness (HU) of the resultant photosensitive member were 55% and 180 N/mm$^2$, respectively.

Example A-3

An electrophotographic photosensitive member was produced in the same manner as in Example A-1.

<Formation of Depressed Portions by Mold Pressing Profile Transfer>

Figure 16:
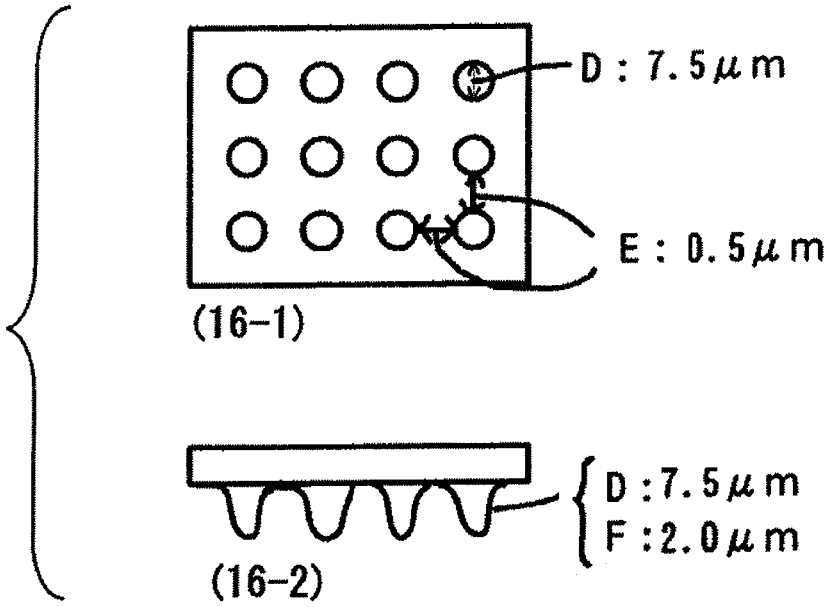
FIG. 16 are views illustrating the shape of a mold used in Example A-3.

Processing was performed in the same manner as in Example A-1 except that the mold used in Example A-1 was changed to a mold for profile transfer illustrated in FIG. 16 (in which hill shapes having a major axis diameter D of 7.5 μm at its bottom and a height F of 2.0 μm were arranged at intervals E of 0.5 μm). In FIG. 16, FIG. 16-1 illustrates the shape of the mold viewed from its top, and FIG. 16-2 illustrates the shape of the mold viewed from its side.

<Observation of Depressed Portions Formed>

Figure 17:
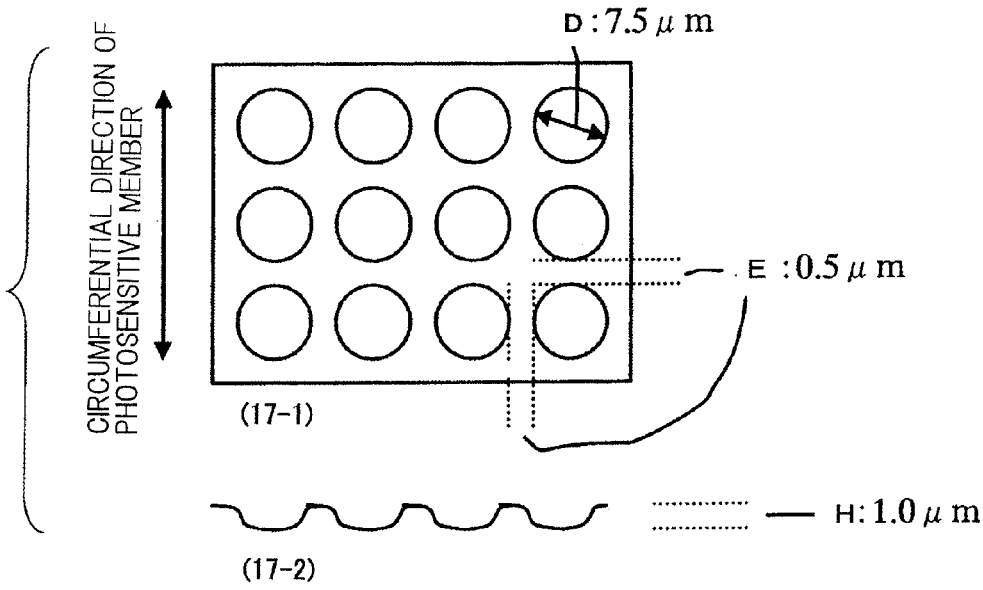
FIG. 17 are partially enlarged views illustrating the arrangement pattern of depressed portions on the surface of an electrophotographic photosensitive member obtained in Example A-3.

The surface shape of the resultant electrophotographic photosensitive member was observed under magnification with a laser microscope (VK-9500 manufactured by KEYENCE CORPORATION). As a result, it was found that hill-shaped depressed portions each having a major axis diameter D of 7.5 μm and a depth H of 1.0 μm were formed at intervals E of 0.5 μm as illustrated in FIG. 17. In FIG. 17, FIG. 17-1 illustrates a state in which the depressed portions are arranged on the surface of the photosensitive member, and FIG. 17-2 illustrates the sectional shape of the surface of the photosensitive member having depressed portions. The average major axis diameter, average depth, number, and area ratio of depressed portions per 100 μm square were as shown in Table 1.

The resultant photosensitive member was evaluated for other items in the same manner as in Example A-1. Table 1 shows the results. Values of the elastic deformation rate and universal hardness (HU) of the resultant photosensitive member were 55% and 180 N/mm$^2$, respectively.

Example A-4

Processing and evaluation were performed in the same manner as in Example A-2 except that the mold used in Example A-2 was changed to a mold having hexagonal columnar shapes each having a major axis diameter of 10.0 μm and a height of 2.0 μm and arranged at intervals of 1.0 μm. Table 1 shows the results. Values of the elastic deformation rate and universal hardness (HU) of the resultant photosensitive member were 55% and 180 N/mm$^2$, respectively.

Example A-5

An electrophotographic photosensitive member was produced in the same manner as in Example A-1.

<Formation of Depressed Portions by Mold Pressing Profile Transfer>

Figure 18:
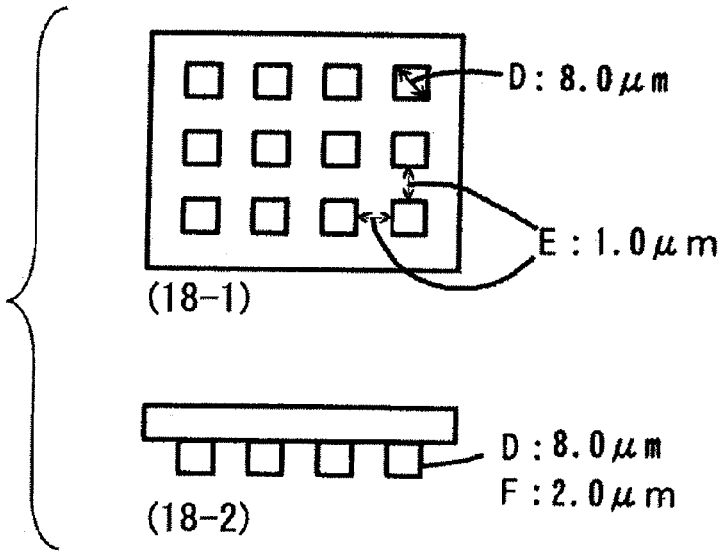
FIG. 18 are views illustrating the shape of a mold used in Example A-5.

Processing was performed in the same manner as in Example A-1 except that the mold used in Example A-1 was changed to a mold for profile transfer illustrated in FIG. 18 (in which square columnar shapes each having a major axis diameter D of 8.0 μm and a height F of 2.0 μm were arranged at intervals E of 1.0 μm). In FIG. 18, FIG. 18-1 illustrates the shape of the mold viewed from its top, and FIG. 18-2 illustrates the shape of the mold viewed from its side.

<Observation of Depressed Portions Formed>

Figure 19:
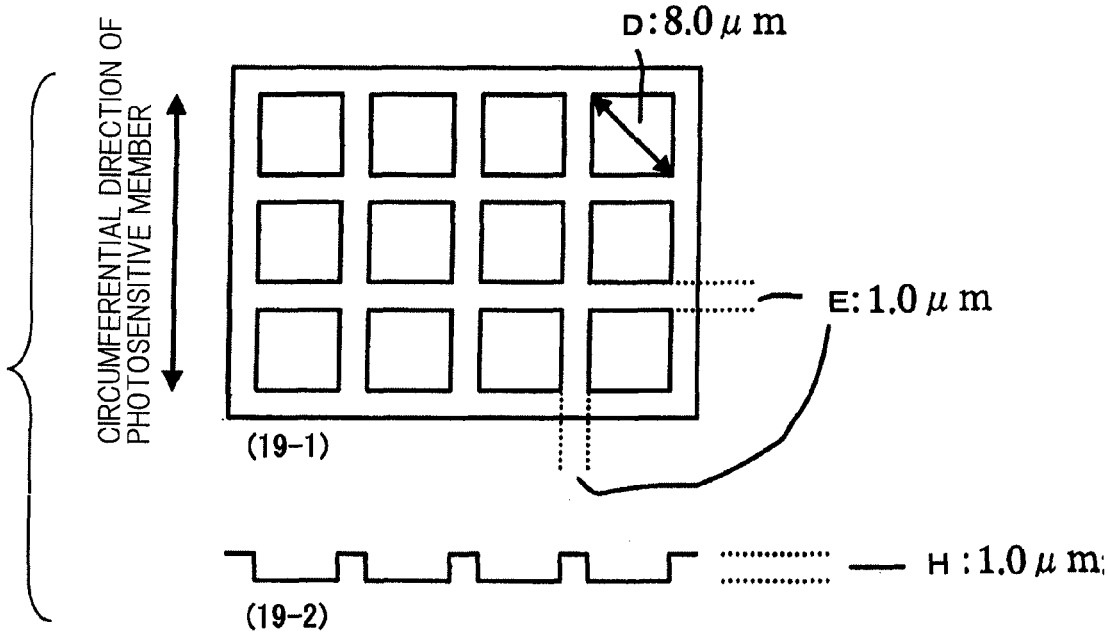
FIG. 19 are partially enlarged views illustrating the arrangement pattern of depressed portions in the surface of an electrophotographic photosensitive member obtained in Example A-5.

The surface profile of the resultant electrophotographic photosensitive member was observed under magnification with a laser microscope (VK-9500 manufactured by KEYENCE CORPORATION). As a result, it was found that square columnar depressed portions each having a major axis diameter D of 8.0 μm and a depth H of 1.0 μm were formed at intervals E of 1.0 μm as illustrated in FIG. 19. In FIG. 19, FIG. 19-1 illustrates a state in which the depressed portions are arranged on the surface of the photosensitive member, and FIG. 19-2 illustrates the sectional shape of the surface of the photosensitive member having depressed portions. The average major axis diameter, average depth, number, and area ratio of depressed portions per 100 μm square were as shown in Table 1.

The resultant photosensitive member was evaluated for other items in the same manner as in Example A-1. Table 1 shows the results. Values of the elastic deformation rate and universal hardness (HU) of the resultant photosensitive member were 55% and 180 N/mm$^2$, respectively.

Example A-6

An electrophotographic photosensitive member was produced in the same manner as in Example A-1.

<Formation of Depressed Portion by Mold Pressing Profile Transfer>

Figure 20:
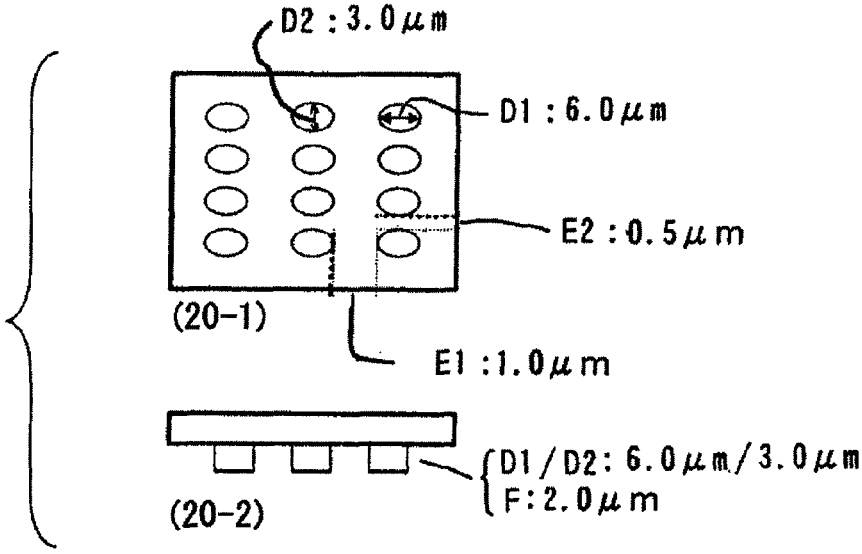
FIG. 20 are views illustrating the shape of a mold used in Example A-6.

Processing was performed in the same manner as in Example A-1 except that the mold used in Example A-1 was changed to a mold for profile transfer illustrated in FIG. 20 (in which elliptic columnar shapes each having a major axis diameter D1 of 6.0 μm, a minor axis diameter D2 of 3.0 μm and a height F of 2.0 μm were arranged at intervals E1 of 1.0

μm between the major axes and at intervals E2 of 0.5 μm between the minor axes). In FIG. 20, FIG. 20-1 illustrates the shape of the mold viewed from its top, and FIG. 20-2 illustrates the shape of the mold viewed from its side.

<Observation of Depressed Portions Formed>

Figure 21:
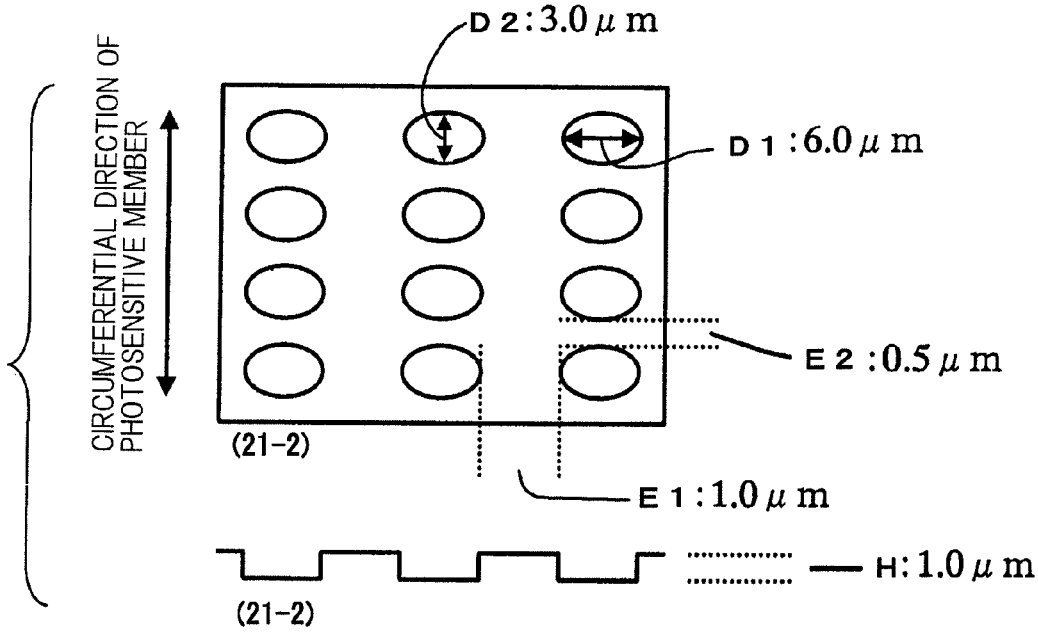
FIG. 21 are partially enlarged views illustrating the arrangement pattern of depressed portions on the surface of an electrophotographic photosensitive member obtained in Example A-6.

The surface shape of the resultant electrophotographic photosensitive member was observed under magnification with a laser microscope (VK-9500 manufactured by KEYENCE CORPORATION). As a result, it was found that elliptic columnar depressed portions each having a major axis diameter D1 of 6.0 μm, a minor axis diameter D2 of 3.0 μm and a depth H of 1.0 μm were formed at intervals of 1.0 μm between the major axes and at intervals E2 of 0.5 μm between the minor axes as illustrated in FIG. 21. In FIG. 21, FIG. 21-1 illustrates a state in which the depressed portions are arranged on the surface of the photosensitive member, and FIG. 21-2 illustrates the sectional shape of the surface of the photosensitive member having depressed portions. The average major axis diameter, average depth, number, and area ratio of depressed portions per 100 μm square were as shown in Table 1.

The resultant photosensitive member was evaluated for other items in the same manner as in Example A-1. Table 1 shows the results. Values of the elastic deformation rate and universal hardness (HU) of the resultant photosensitive member were 55% and 180 N/mm$^2$, respectively.

Example A-7

Processing and evaluation were performed in the same manner as in Example A-5 except that the mold used in Example A-5 was changed to a mold having square columnar shapes each having a major axis diameter of 12.0 μm and a height of 2.0 μm and arranged at intervals of 2.5 μm. Table 1 shows the results. Values for the elastic deformation rate and universal hardness (HU) of the resultant photosensitive member were 55% and 180 N/mm$^2$, respectively.

Example A-8

Processing and evaluation were performed in the same manner as in Example A-5 except that the mold used in Example A-5 was changed to a mold having square columnar shapes each having a major axis diameter of 14.0 μm and a height of 2.0 μm and arranged at intervals of 1.0 μm. Table 1 shows the results. Values of the elastic deformation rate and universal hardness (HU) of the resultant photosensitive member were 55% and 180 N/mm$^2$, respectively.

Example A-9

Processing and evaluation were performed in the same manner as in Example A-1 except that the mold used in Example A-1 was changed to a mold having cylindrical shapes each having a major axis diameter of 4.0 μm and a height of 2.0 μm and arranged at intervals of 1.0 μm. Table 1 shows the results. Values of the elastic deformation rate and universal hardness (HU) of the resultant photosensitive member were 55% and 180 N/mm$^2$, respectively.

Example A-10

Processing and evaluation were performed in the same manner as in Example A-1 except that the mold used in Example A-1 was changed to a mold having cylindrical shapes each having a major axis diameter of 3.0 μm and a height of 2.0 μm and arranged at intervals of 0.5 μm. Table 1 shows the results. Values of the elastic deformation rate and universal hardness (HU) of the resultant photosensitive member were 55% and 180 N/mm$^2$, respectively.

Example A-11

An electrophotographic photosensitive member was produced in the same manner as in Example A-1 except that the composition of the second charge transporting layer coating liquid in Example A-1 was changed as shown below, and the electrophotographic photosensitive member was evaluated in the same manner as in Example A-1. Table 1 shows the results. Values of the elastic deformation rate and universal hardness (HU) of the resultant electrophotographic photosensitive member were 62% and 200 N/mm$^2$, respectively.

—Second Charge Transporting Layer Coating Liquid—

80 parts of 1,1,2,2,3,3,4-heptafluorocyclopentane (trade name: ZEORORA H, manufactured by ZEON CORPORATION), 80 parts of 1-propanol, and 90 parts of the hole transportable compound represented by the structural formula (3) were mixed and stirred, and then, filtrated through a Polyflon filter (trade name: PF-020, manufactured by ADVANTEC), whereby a second charge transporting layer coating liquid was prepared.

Example A-12

An electrophotographic photosensitive member was produced in the same manner as in Example A-1 except that: the amount of the fluorine atom-containing resin (trade name: GF-300, manufactured by TOAGOSEI CO., LTD.) was changed to 1.5 parts; the amount of the tetrafluoroethylene resin powder (trade name: Rubron L-2, manufactured by DAIKIN INDUSTRIES, ltd.) was changed to 30 parts; and the amount of the hole transportable compound represented by the structural formula (3) was changed to 70 parts, and the electrophotographic photosensitive member was evaluated in the same manner as in Example A-1. Table 1 shows the results. Values for the elastic deformation rate and universal hardness (HU) of the resultant electrophotographic photosensitive member were 50% and 175 N/mm$^2$, respectively.

Example A-13

Processing and evaluation were performed in the same manner as in Example A-1 except that: the mold used in Example A-1 was changed to a mold having cylindrical shapes each having a major axis diameter of 10.0 μm and a height of 2.0 μm and arranged at intervals of 1.0 μm; and the temperature of the electrophotographic photosensitive member and the mold was controlled so that the temperature of the surface of the electrophotographic photosensitive member at the time of the processing was 110° C., and the processing was performed at a pressure of 5.0 MPa. Table 1 shows the results. Values of the elastic deformation rate and universal hardness (HU) of the resultant photosensitive member were 55% and 180 N/mm$^2$, respectively.

Example A-14

Processing and evaluation were performed in the same manner as in Example A-1 except that the mold used in Example A-13 was changed to a mold having cylindrical shapes each having a major axis diameter of 5.0 μm and a height of 2.0 μm and arranged at intervals of 2.0 μm. Table 1 shows the results. Values of the elastic deformation rate and universal hardness (HU) of the resultant photosensitive member were 55% and 180 N/mm$^2$, respectively.

Example A-15

An electrophotographic photosensitive member having a protective layer (second charge transporting layer) having a thickness of 5 μm was produced in the same manner as in Example A-1. Next, the surface profile processing of the electrophotographic photosensitive member was carried out by the following laser processing instead of the mold pressing profile transfer.

<Formation of Depressed Portions by Excimer Laser>

Figure 22:
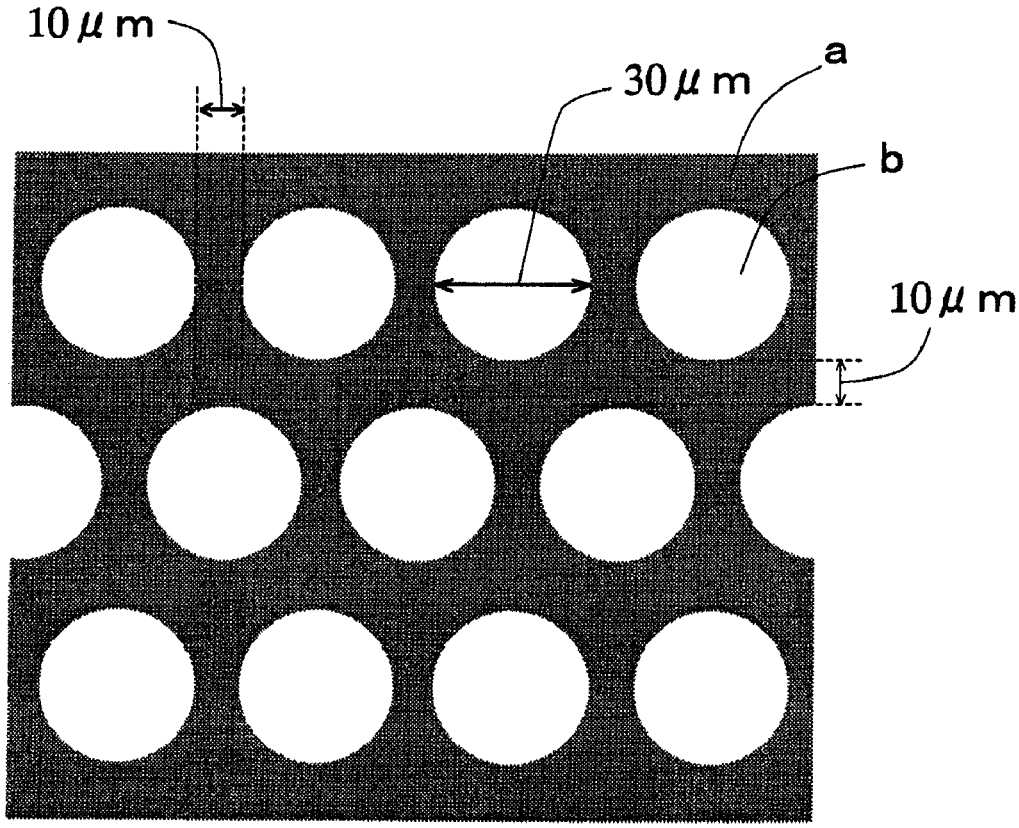
FIG. 22 is a partially enlarged view illustrating the arrangement pattern of a mask used in Example A-15.

Depressed portions were formed in the outermost surface layer of the resultant electrophotographic photosensitive member with KrF excimer laser (wavelength λ=248 nm). In this case, a mask made of quartz glass was used which had a pattern in which circular transparent areas to laser light "b" each having a diameter of 30 μm were arranged at intervals of 10 μm as illustrated in FIG. 22. The irradiation energy of the excimer laser was 0.9 J/cm$^2$, and the irradiation area was 2 mm square for each irradiation. The irradiation was performed while the photosensitive member was rotated and the position to be irradiated was shifted in the axial direction as illustrated in FIG. 4.

<Observation of Depressed Portions Formed>

Figure 23:
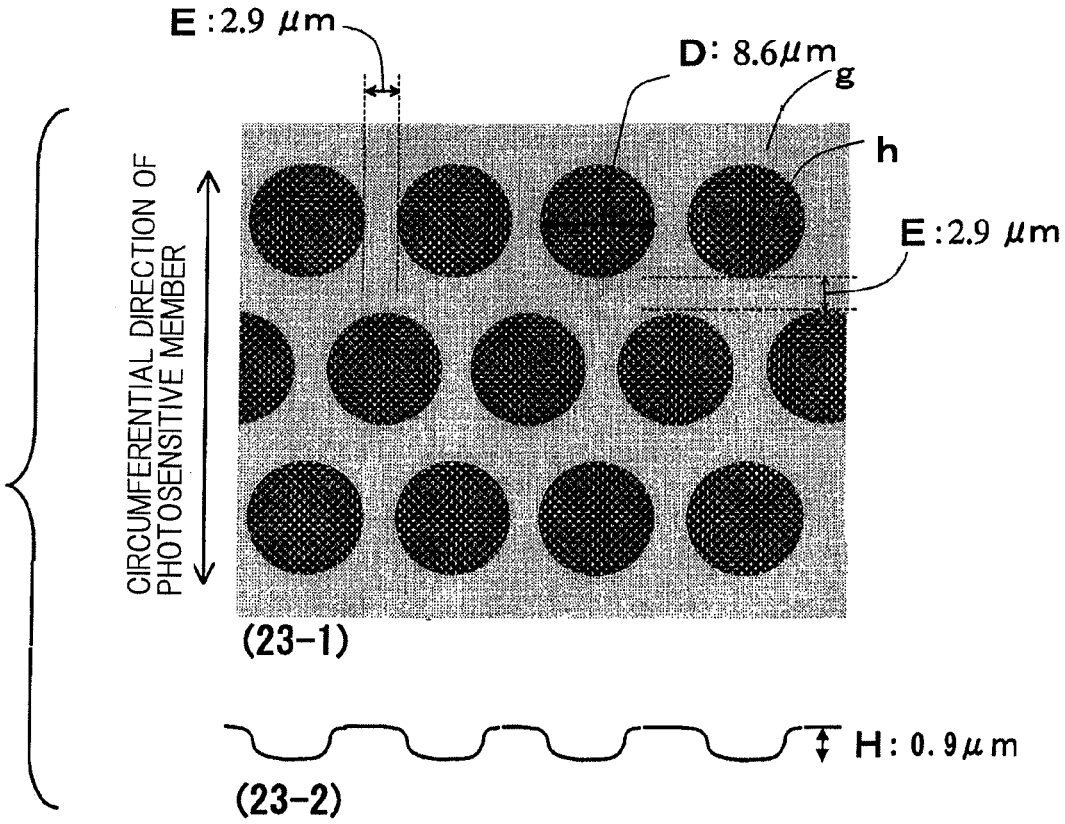
FIG. 23 are partially enlarged views illustrating the arrangement pattern of depressed portions on the surface of an electrophotographic photosensitive member obtained in Example A-15.

The surface shape of the resultant electrophotographic photosensitive member was observed under magnification with a laser microscope (VK-9500 manufactured by KEYENCE CORPORATION). As a result, it was found that cylindrical depressed portions each having no edge and having a major axis diameter D of 8.6 μm and a depth H of 0.9 μm were formed at intervals E of 2.9 μm as illustrated in each of FIG. 23. In FIG. 23, FIG. 23-1 illustrates a state in which the depressed portions are arranged on the surface of the photosensitive member, and FIG. 23-2 illustrates the sectional shape of the surface of the photosensitive member having depressed portions. The average major axis diameter, average depth, number, and area ratio of depressed portions per 100 μm square were as shown in Table 1.

The resultant photosensitive member was evaluated for other items in the same manner as in Example A-1. Table 1 shows the results. Values of the elastic deformation rate and universal hardness (HU) of the resultant photosensitive member were 55% and 180 N/mm$^2$, respectively.

Example A-16

Figure 24:
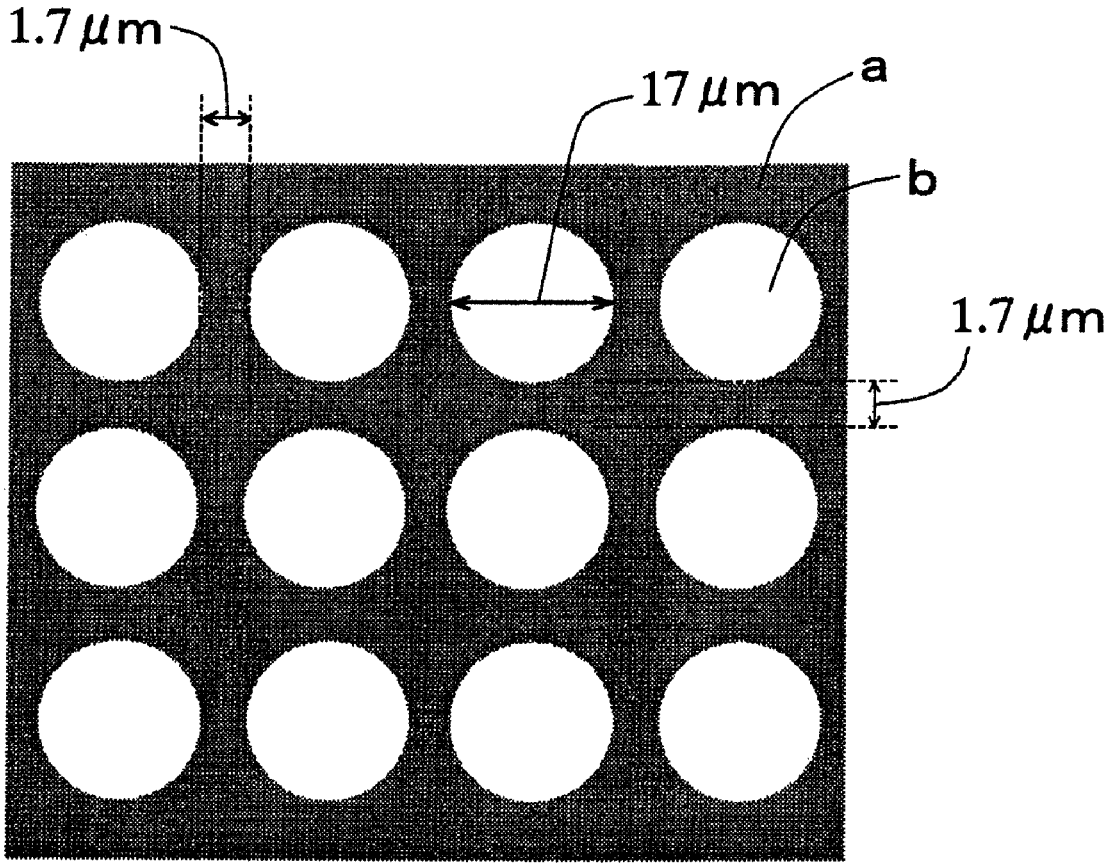
FIG. 24 is a partially enlarged view illustrating the arrangement pattern of a mask used in Example A-16.

An electrophotographic photosensitive member was processed in the same manner as in Example A-15 except that: the mask illustrated in FIG. 22 was changed to a mask illustrated in FIG. 24; and the irradiation energy of the excimer laser was changed to 1.2 J/cm$^2$, and the electrophotographic photosensitive member was evaluated in the same manner as in Example A-1. Table 1 shows the results. Values of the elastic deformation rate and universal hardness (HU) of the resultant photosensitive member were 55% and 180 N/mm$^2$, respectively.

Example A-17

Figure 25:
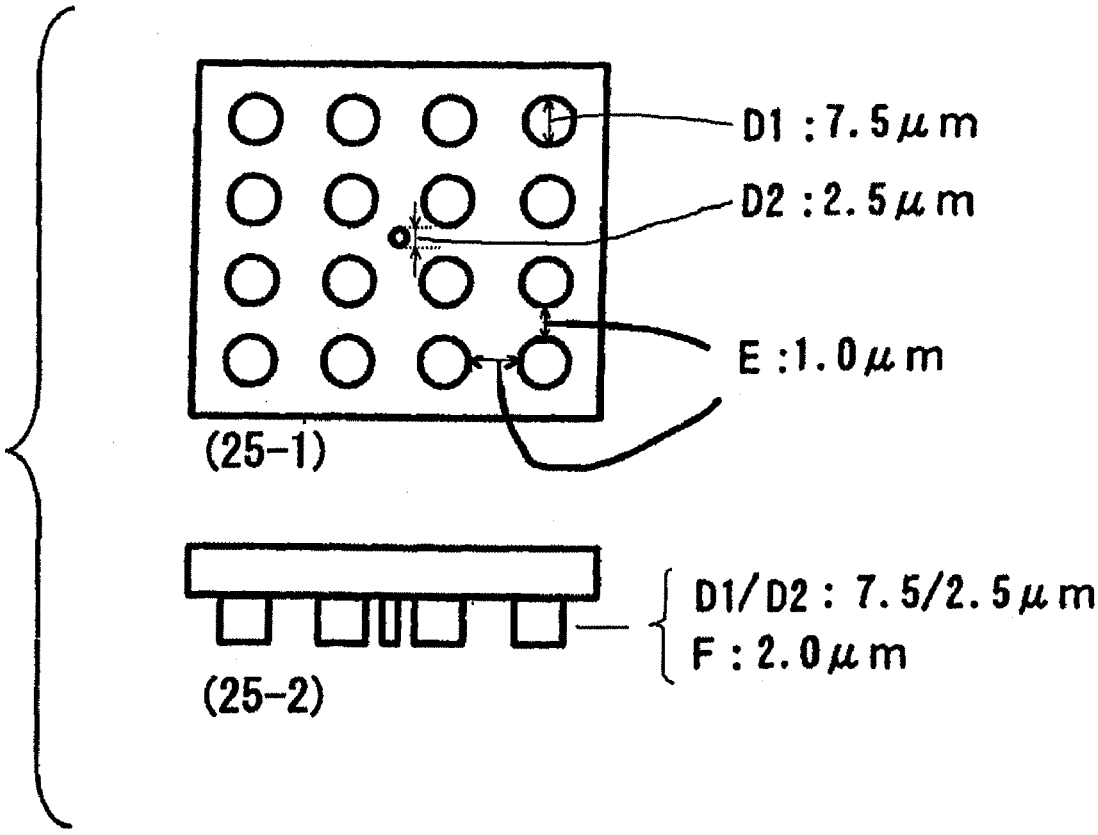
FIG. 25 are views illustrating the shape of a mold used in Example A-17.

Processing was performed in the same manner as in Example A-1 except that the mold used in Example A-1 was changed to a mold for profile transfer illustrated in FIG. 25 (in which two kinds of cylinders, i.e., cylinders each having a major axis diameter D1 of 7.5 μm and a height F of 2.0 μm and arranged at intervals E of 1.0 μm, and cylinders each having a major axis diameter D2 of 2.5 μm and a height F of 2.0 μm, were present in combination). In FIG. 25, FIG. 25-1 illustrates the shape of the mold viewed from its top, and FIG. 25-2 illustrates the shape of the mold viewed from its side.

<Observation of Depressed Portions Formed>

Figure 26:
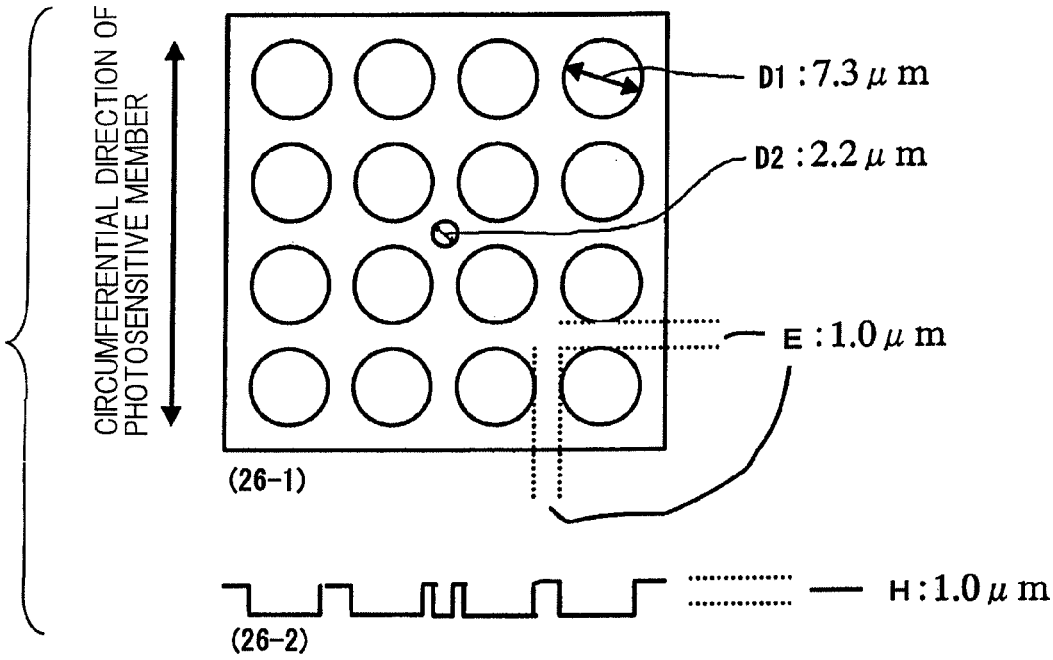
FIG. 26 are partially enlarged views illustrating the arrangement pattern of depressed portions on the surface of an electrophotographic photosensitive member obtained in Example A-17.

The surface shape of the resultant electrophotographic photosensitive member was observed under magnification with a laser microscope (VK-9500 manufactured by KEYENCE CORPORATION). As a result, it was found that cylindrical depressed portions each having a major axis diameter D1 of 7.3 μm and a depth H of 1.0 μm were formed at intervals E of 1.0 μm, and one cylindrical depressed portion having a major axis diameter D2 of 2.2 μm and a depth H of 1.0 μm was formed for every 16 of the cylindrical depressed portions each having a major axis diameter D1 of 7.3 μm as illustrated in each of FIG. 26. In FIG. 26, FIG. 26-1 illustrates a state in which the depressed portions are arranged on the surface of the photosensitive member, and FIG. 26-2 illustrates the sectional shape of the surface of the photosensitive member having depressed portions. The average major axis diameter, average depth, number, and area ratio of depressed portions per 100 μm square were as shown in Table 1. In addition, depressed portions each having a major axis diameter of 3.0 μm or less accounted for 6 number % of all depressed portions.

The resultant photosensitive member was evaluated for other items in the same manner as in Example A-1. Table 1 shows the results. Values for the elastic deformation rate and universal hardness (HU) of the resultant photosensitive member were 55% and 180 N/mm$^2$, respectively.

Example A-18

Figure 27:
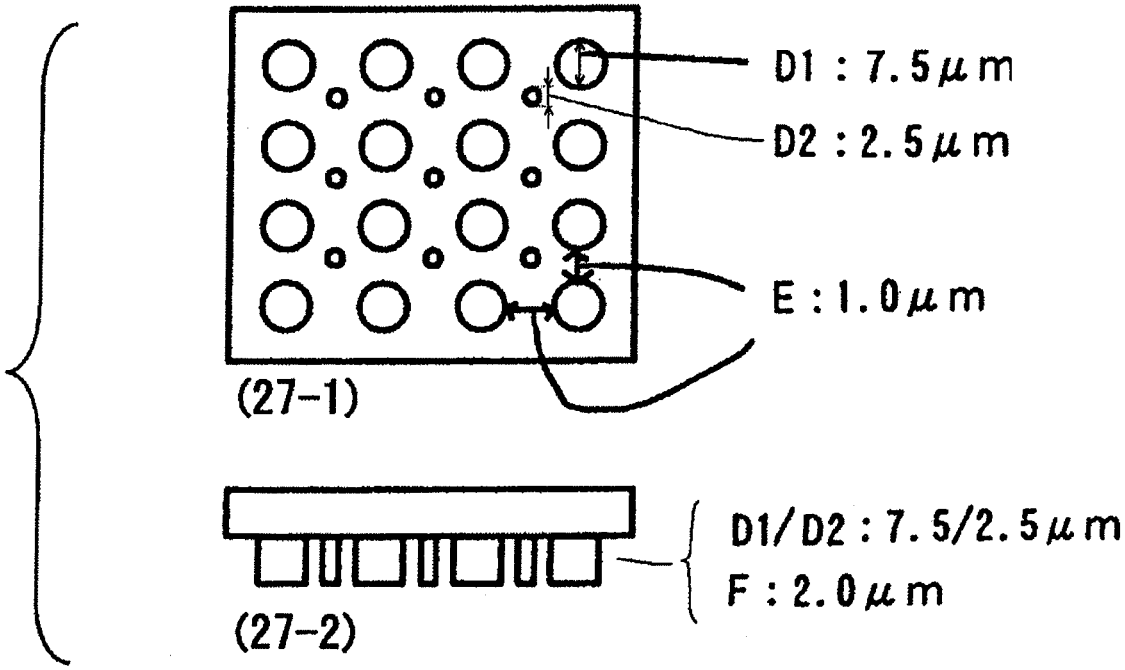
FIG. 27 are views illustrating the shape of a mold used in Example A-18.

Processing was performed in the same manner as in Example A-1 except that the mold used in Example A-1 was changed to a mold for profile transfer illustrated in FIG. 27 (in which two kinds of cylinders, i.e., cylinders each having a major axis diameter D1 of 7.5 μm and a height F of 2.0 μm and arranged at intervals E of 1.0 μm, and cylinders each having a major axis diameter D2 of 2.5 μm and a height F of 2.0 μm, were present in combination). In FIG. 27, FIG. 27-1 illustrates the shape of the mold viewed from its top, and FIG. 27-2 illustrates the shape of the mold viewed from its side.

<Observation of Depressed Portions Formed>

Figure 28:
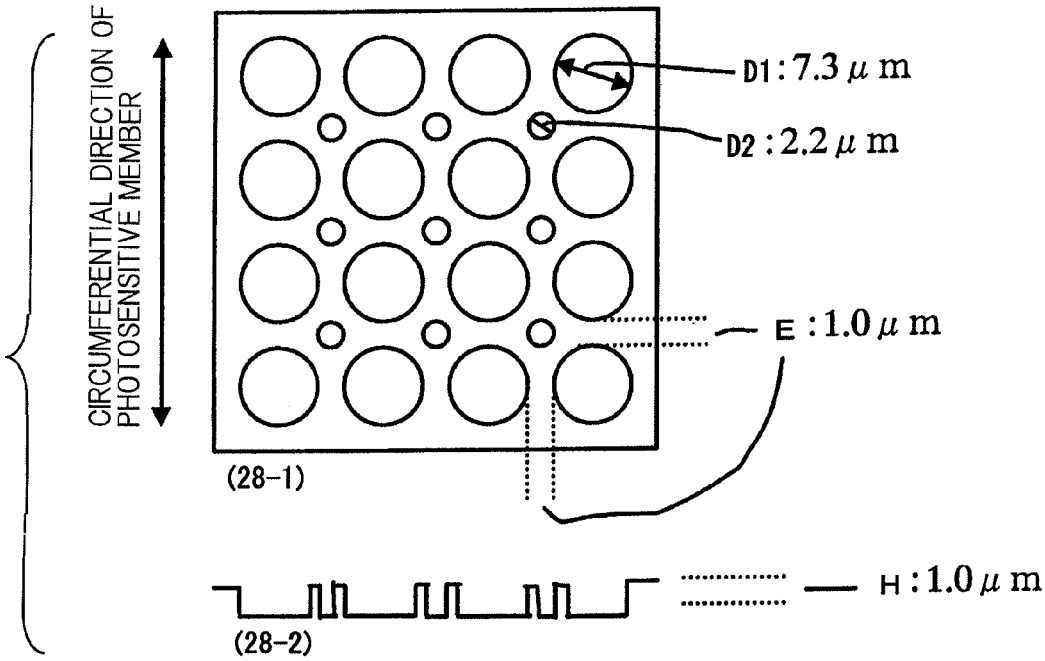
FIG. 28 are partially enlarged views illustrating the arrangement pattern of depressed portions on the surface of an electrophotographic photosensitive member obtained in Example A-18.

The surface profile of the resultant electrophotographic photosensitive member was observed under magnification with a laser microscope (VK-9500 manufactured by KEYENCE CORPORATION). As a result, it was found that cylindrical depressed portions each having a major axis diameter D1 of 7.3 μm and a depth H of 1.0 μm were formed at intervals E of 1.0 μm, and one cylindrical depressed portion having a major axis diameter D2 of 2.2 μm and a depth H of 1.0 μm was formed for every four of the cylindrical depressed portions described above as illustrated in FIG. 28. In FIG. 28, FIG. 28-1 illustrates a state in which the depressed portions are arranged on the surface of the photosensitive member, and FIG. 28-2 illustrates the sectional shape of the surface of the photosensitive member having depressed portions. The average major axis diameter, average depth, number, and area ratio of depressed shape portions per 100 μm square were as shown in Table 1. In addition, depressed portions each having a major axis diameter of 3.0 μm or less accounted for 46 number % of all depressed portions.

The resultant photosensitive member was evaluated for other items in the same manner as in Example A-1. Table 1 shows the results. Values of the elastic deformation rate and universal hardness (HU) of the resultant photosensitive member were 55% and 180 N/mm$^2$, respectively.

Example A-19

Figure 29:
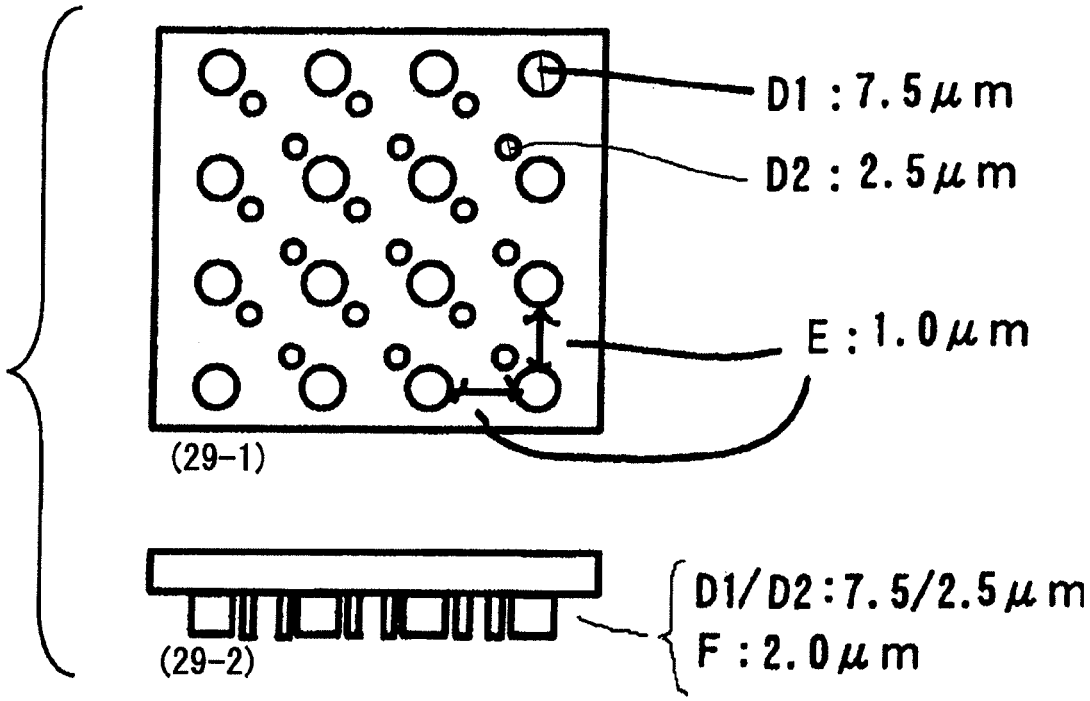
FIG. 29 are views illustrating the shape of a mold used in Example A-19.

Processing was performed in the same manner as in Example A-1 except that the mold used in Example A-1 was changed to a mold for profile transfer illustrated in FIG. 29 (in which two kinds of cylinders, i.e., cylinders each having a major axis diameter D1 of 7.5 μm and a height F of 2.0 μm and arranged at intervals E of 1.0 μm and cylinders each having a major axis diameter D2 of 1.5 μm and a height F of 2.0 μm, were present in combination). In FIG. 29, FIG. 29-1 illustrates the shape of the mold viewed from its top, and FIG. 29-2 illustrates the shape of the mold viewed from its side.

<Observation of Depressed Portions Formed>

Figure 30:
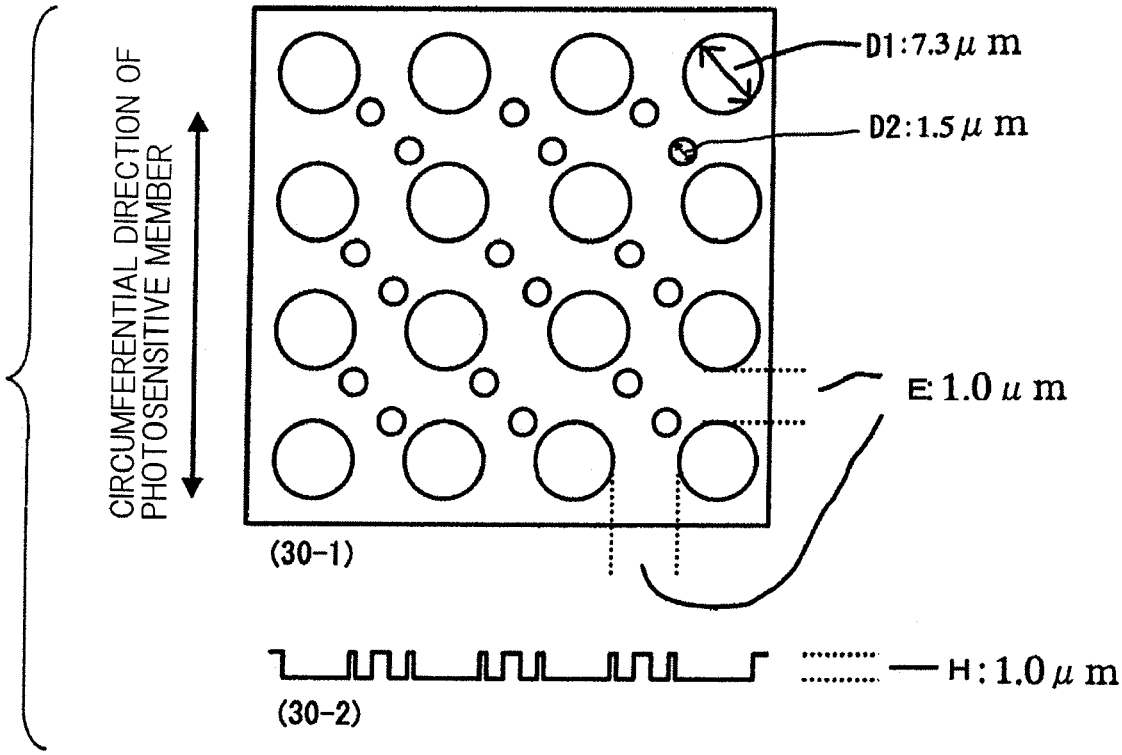
FIG. 30 are partially enlarged views illustrating the arrangement pattern of depressed portions in the surface of an electrophotographic photosensitive member obtained in Example A-19.

The surface shape of the resultant electrophotographic photosensitive member was observed under magnification with a laser microscope (VK-9500 manufactured by KEYENCE CORPORATION). As a result, it was found that cylindrical depressed portions each having a major axis diameter D1 of 7.3 μm and a depth H of 1.0 μm were formed at intervals E of 1.0 μm, and two cylindrical depressed portions each having a major axis diameter D2 of 1.5 μm and a depth H of 1.0 μm were formed for every four of the cylindrical depressed portions as illustrated in FIG. 30. In FIG. 30, FIG. 30-1 illustrates a state in which the depressed portions are arranged on the surface of the photosensitive member, and FIG. 30-2 illustrates the sectional shape of the surface of the photosensitive member having depressed portions. The average major axis diameter, average depth, number, and area ratio of depressed portions per 100 μm square were as shown in Table 1. In addition, depressed portions each having a major axis diameter of 3.0 μm or less accounted for 63 number % of all depressed portions.

The resultant photosensitive member was evaluated for other items in the same manner as in Example A-1. Table 1 shows the results. Values for the elastic deformation rate and universal hardness (HU) of the resultant photosensitive member were 55% and 180 N/mm$^2$, respectively.

As can be seen from the above-mentioned results, the electrophotographic photosensitive member of the present invention suppresses the occurrence of image defects due to melt adhesion even in the case of low image density in a high-temperature, high-humidity environment, and has good cleaning performance. In addition, the electrophotographic photosensitive member shows particularly good results when the depressed portions have an average major axis diameter of 5.0 μm or more and 10 μm or less, the number of the depressed portions per 100 μm square is 100 or more, and besides, the area ratio of the depressed portions is 61% or more. Further, the electrophotographic photosensitive member shows the best results when depressed portions each having a major axis diameter of 3.0 μm or less account for 10 number % or less of all depressed portions.

Comparative Example A-1

Processing and evaluation were performed in the same manner as in Example A-1 except that the mold used in Example A-1 was changed to a mold having cylindrical shapes each having a major axis diameter of 2.5 μm and a height of 2.0 μm and arranged at intervals of 11.0 μm. Table 1 shows the results. However, evaluation for the escape of toner due to cleaning failure was not performed because the chipping of a blade due to the occurrence of melt adhesion was observed. Values of the elastic deformation rate and universal hardness (HU) of the resultant photosensitive member were 55% and 180 N/mm$^2$, respectively.

Comparative Example A-2

Processing and evaluation were performed in the same manner as in Example A-1 except that the mold used in Example A-1 was changed to a mold having cylindrical shapes each having a major axis diameter of 2.5 μm and a height of 2.0 μm and arranged at intervals of 0.5 μm. Table 1 shows the results. However, evaluation for the escape of toner due to cleaning failure was not performed because the chipping of a blade due to the occurrence of melt adhesion was observed. Values of the elastic deformation rate and universal hardness (HU) of the resultant photosensitive member were 55% and 180 N/mm$^2$, respectively.

Comparative Example A-3

Processing and evaluation were performed in the same manner as in Example A-1 except that the mold used in Example A-1 was changed to a mold having cylindrical shapes each having a major axis diameter of 1.5 μm and a height of 2.0 μm and arranged at intervals of 0.5 μm. Table 1 shows the results. However, evaluation for the escape of toner due to cleaning failure was not performed because the chipping of a blade due to the occurrence of melt adhesion was observed. Values of the elastic deformation rate and universal hardness (HU) of the resultant photosensitive member were 55% and 180 N/mm$^2$, respectively.

Comparative Example A-4

Processing and evaluation were performed in the same manner as in Example A-15 except that a mask made of quartz glass having a pattern in which circular transparent areas to laser light each having a diameter of 100 μm were arranged at intervals of 10 μm was used instead of the mask illustrated in FIG. 21 and used in Example A-15. Table 1 shows the results. However, evaluation for the escape of toner due to cleaning failure was not performed because the chipping of a blade due to the occurrence of melt adhesion was observed. Values of the elastic deformation rate and universal hardness (HU) of the resultant photosensitive member were 55% and 180 N/mm$^2$, respectively.

Comparative Example A-5

Processing and evaluation were performed in the same manner as in Example A-15 except that a mask made of quartz glass having a pattern in which circular transparent areas to laser light each having a diameter of 70 μm were arranged at intervals of 7 μm was used instead of the mask illustrated in FIG. 21 and used in Example A-15. Table 1 shows the results. However, evaluation for the escape of toner due to cleaning failure was not performed because the chipping of a blade due to the occurrence of melt adhesion was observed. Values of the elastic deformation rate and universal hardness (HU) of the resultant photosensitive member were 55% and 180 N/mm$^2$, respectively.

Comparative Example A-6

Processing and evaluation were performed in the same manner as in Example A-15 except that a mask made of quartz glass having a pattern in which circular transparent areas to laser light each having a diameter of 35 μm were arranged at intervals of 18 μm was used instead of the mask illustrated in FIG. 21 and used in Example A-15. Table 1 shows the results. However, evaluation for the escape of toner due to cleaning failure was not performed because the chipping of a blade due to the occurrence of melt adhesion was observed. Values of the elastic deformation rate and universal hardness (HU) of the resultant photosensitive member were 55% and 180 $N/mm^2$, respectively.

As can be seen from the above-mentioned results, the electrophotographic photosensitive member in the Comparative Examples tended to cause a problem of melt adhesion because the average major axis diameter of depressed portions and the number of depressed portions per 100 μm square were outside the range of the present invention.

TABLE 1

| | | Average major axis diameter (μm) | Average interval (μm) | Average depth (μm) | Number/ 100 μm square | Area ratio (%) | Melt adhesion | Toner escape due to cleaning failure |
|---|---|---|---|---|---|---|---|---|
| Example A- | 1 | 5.0 | 0.5 | 1.0 | 324 | 64 | A | A |
| | 2 | 5.0 | 0.5 | 1.0 | 449 | 73 | A | A |
| | 3 | 7.5 | 0.5 | 1.0 | 144 | 65 | A | A |
| | 4 | 10.0 | 1.0 | 1.0 | 105 | 68 | A | A |
| | 5 | 8.0 | 1.0 | 1.0 | 225 | 72 | A | A |
| | 6 | 6.0 | 1.0 | 1.0 | 392 | 55 | A | B |
| | 7 | 12.0 | 2.6 | 1.0 | 81 | 59 | B | C |
| | 8 | 14.0 | 1.0 | 1.0 | 81 | 79 | C | B |
| | 9 | 3.9 | 1.0 | 1.0 | 400 | 48 | B | C |
| | 10 | 3.1 | 0.5 | 1.0 | 729 | 55 | C | C |
| | 11 | 5.0 | 0.5 | 1.0 | 324 | 64 | A | A |
| | 12 | 5.0 | 0.5 | 1.0 | 324 | 64 | A | A |
| | 13 | 10.0 | 1.0 | 1.0 | 81 | 64 | B | B |
| | 14 | 5.0 | 2.0 | 1.0 | 204 | 40 | A | B |
| | 15 | 8.6 | 2.9 | 0.9 | 76 | 43 | B | B |
| | 16 | 5.0 | 0.5 | 1.0 | 324 | 65 | A | A |
| | 17 | 7.0 | 1.0 | 1.0 | 153 | 61 | A | A |
| | 18 | 5.0 | 1.0 | 1.0 | 265 | 65 | B | A |
| | 19 | 3.7 | 1.0 | 1.0 | 386 | 65 | C | A |
| Comparative | 1 | 2.5 | 11.0 | 1.0 | 49 | 3 | D | — |
| Example A- | 2 | 2.4 | 0.6 | 1.0 | 1089 | 49 | D | — |
| | 3 | 1.5 | 0.5 | 1.0 | 2500 | 44 | D | — |
| | 4 | 29.2 | 2.9 | 0.9 | 10 | 70 | D | — |
| | 5 | 20.5 | 2.1 | 0.9 | 20 | 65 | D | — |
| | 6 | 10.0 | 4.9 | 0.9 | 46 | 33 | D | — |

Example B-1

A charge transporting layer was formed in the same manner as in Example A-1 except that a copolymer type polyallylate resin represented by the following structural formula (4) was used instead of a polycarbonate resin (IUPIRON Z400, manufactured by Mitsubishi Engineering-Plastics Corporation). After that, an electrophotographic photosensitive member in which a second charge transporting layer was not formed was obtained.

(Copolymerization ratio m:n=7:3, weight average molecular weight 130,000)

<Formation of Depressed Portions by Mold Pressing Profile Transfer>

Processing was performed in the same manner as in Example A-1 except that the temperature of the surface of the electrophotographic photosensitive member at the time of the processing was changed to 110° C.

<Observation of Depressed Portions Formed>

The surface profile of the resultant electrophotographic photosensitive member was observed under magnification with a laser microscope (VK-9500 manufactured by KEYENCE CORPORATION). As a result, it was found that cylindrical depressed portions each having a major axis diameter of 5.0 μm and a depth of 1.5 μm were formed at intervals of 0.5 μm. The average major axis diameter, average depth, number, and area ratio of depressed shape portions per 100 μm square were as shown in Table 2.

<Evaluation of Electrophotographic Photosensitive Member in Practical Operation>

The electrophotographic photosensitive member obtained as described above was mounted on a modified device of a laser beam printer (LBP-930) manufactured by Canon Inc., and was evaluated as described below.

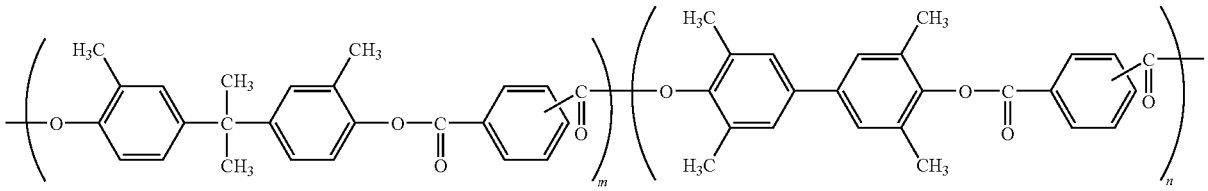

First, conditions for potential were set so that the dark potential (Vd) and light potential (Vl) of the electrophotographic photosensitive member in an environment having a temperature of 32.5° C. and a humidity of 85% RH were −700 V and −200 V, respectively, and the initial potential of the electrophotographic photosensitive member was adjusted.

Next, a cleaning blade made of polyurethane rubber was set at a contact angle of 26° and a contact pressure of 20 g/cm$^2$ with respect to the surface of the electrophotographic photosensitive member.

After that, a durability test was performed in which 10,000 sheets of A4 size paper were printed in a 10-sheet intermittent mode. A test chart having a printing ratio of 5% was used only for the first sheet of the 10 sheets, and a solid white image was used for the other 9 sheets. After the completion of the durability test, solid white, solid black, and half tone test images were output, and image defects due to toner melt adhesion were observed. Further, the surface of the electrophotographic photosensitive member was observed with a microscope, and was evaluated on the basis of the following criteria.

A: No image defects due to toner melt adhesion are observed on any images, and no toner melt adhesion occurs on the surface of the electrophotographic photosensitive member.

B: No image defects due to toner melt adhesion are observed on any images, but extremely slight toner melt adhesion occurs on part of the surface of the electrophotographic photosensitive member.

C: No image defects due to toner melt adhesion are observed on solid white images, but extremely slight image defects due to toner melt adhesion are observed on half tone images and solid black images, and slight toner melt adhesion occurs on the entire surface of the electrophotographic photosensitive member.

D: Image defects due to toner melt adhesion occurs on any images, and remarkable toner melt adhesion occurs on the entire surface of the electrophotographic photosensitive member.

Further, the cleaning blade edge on the downstream side in the rotation direction of the electrophotographic photosensitive member after the durability test was observed, and evaluation was made on a state in which toner escaped owing to cleaning failure on the basis of the following criteria.

A: No escape of toner occurs.

B: The extremely slight escape of toner occurs in part of the longitudinal direction of the electrophotographic photosensitive member.

C: The escape of toner occurs over the entire region in the longitudinal direction of the electrophotographic photosensitive member.

As a result, no image failure due to toner melt adhesion was observed on any test image, and no toner melt adhesion was observed in the observation of the surface of the electrophotographic photosensitive member with a microscope. Further, no escape of toner due to cleaning failure was observed.

Example B-2

An electrophotographic photosensitive member was produced in the same manner as in Example B-1. Next, the surface profile processing of the electrophotographic photosensitive member was performed by the same laser processing as in Example A-15 instead of mold pressing profile transfer.

<Observation of Depressed Portions Formed>

The surface profile of the resultant electrophotographic photosensitive member was observed under magnification with a laser microscope (VK-9500 manufactured by KEYENCE CORPORATION). As a result, it was found that cylindrical depressed portions each having a major axis diameter of 8.1 μm and a depth of 1.0 μm and having no edge were formed at intervals of 2.5 μm. The average major axis diameter, average depth, number, and area ratio of depressed portions per 100 μm square were as shown in Table 2.

The resultant photosensitive member was evaluated for other items in the same manner as in Example B-1. Table 2 shows the results.

Example B-3

A conductive layer, an intermediate layer, and a charge generating layer were formed in the same manner as in Example A-1.

<Formation of Depressed Portions by Condensation Method>

Next, 70 parts of a hole transportable compound represented by the structural formula (2) and 100 parts of a polycarbonate resin (IUPIRON Z400, manufactured by Mitsubishi Engineering-Plastics Corporation) were dissolved in a mixed solvent of 550 parts of monochlorobenzene and 300 parts of methylal, whereby a surface layer coating liquid containing a charge transporting substance was prepared. The step of preparing the surface layer coating liquid was performed in an environment having a relative humidity of 45% and an ambient temperature of 25° C.

The step of applying the surface layer coating liquid onto a cylindrical support was performed by dip-coating the charge generating layer with the surface layer coating liquid. The step of applying the surface layer coating liquid was performed in an environment having a relative humidity of 45% and an ambient temperature of 25° C.

60 seconds after the completion of the applying step, the cylindrical support to which the surface layer coating liquid had been applied was held for 120 seconds in a device the inside of which had been brought into conditions in which relative humidity was 70% and ambient temperature was 60° C.

60 seconds after the completion of the cylindrical support holding step, the cylindrical support was placed in a blast drier the inside of which had been heated to 120° C., and was subjected to a drying step for 60 minutes.

Thus, an electrophotographic photosensitive member was produced which has as a surface layer a charge transporting layer 20 μm in thickness having depressed portions.

<Observation of Depressed Portions Formed>

Figure 31:
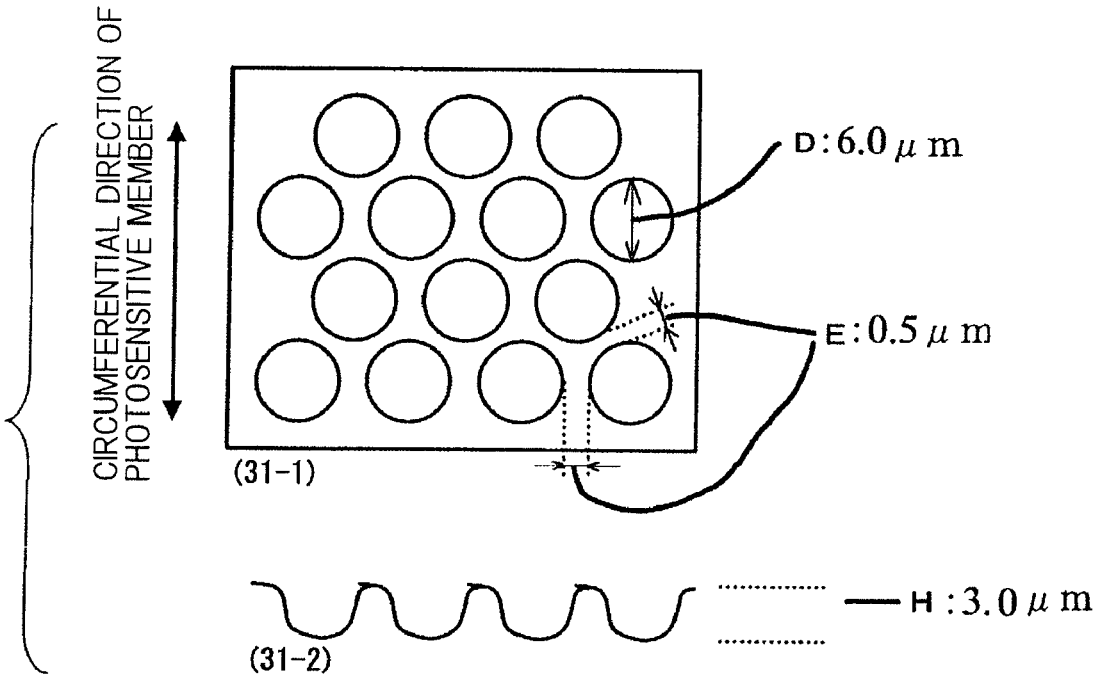
FIG. 31 are partially enlarged views illustrating the arrangement pattern of depressed shape portions on the surface of an electrophotographic photosensitive member obtained in Example B-3.

The surface profile of the resultant electrophotographic photosensitive member was observed under magnification with a laser microscope (VK-9500 manufactured by KEYENCE CORPORATION). As a result, it was found that depressed portions each having a major axis diameter D of 6.0 μm and a depth H of 3.0 μm were formed at intervals E of 0.5 μm as illustrated in FIG. 31. In FIG. 31, FIG. 31-1 illustrates a state in which the depressed portions are arranged on the surface of the photosensitive member, and FIG. 31-2 illustrates the sectional shape of the surface of the photosensitive member having depressed portions. The average major axis diameter, average depth, number, and area ratio of depressed portions per 100 μm square were as shown in Table 2.

<Evaluation of Electrophotographic Photosensitive Member in Practical Operation>

The resultant photosensitive member was evaluated for other items in the same manner as in Example B-1. Table 2 shows the results.

Example B-4

A conductive layer, an intermediate layer, and a charge generating layer were formed in the same manner as in Example A-1.

<Formation of Depressed Portions by Condensation Method>

Next, 70 parts of a hole transportable compound represented by the structural formula (5) and 100 parts of a polycarbonate resin (IUPIROIN Z400, manufactured by Mitsubishi Engineering-Plastics Corporation) were dissolved in a mixed solvent of 550 parts of monochlorobenzene, 280 parts of methylal, and 20 parts of 1-methylpyrrolidin-2-one, whereby a surface layer coating liquid containing a charge transporting substance was prepared. The step of preparing the surface layer coating liquid was performed in an environment having a relative humidity of 45% and an ambient temperature of 25° C.

(CTM-2)

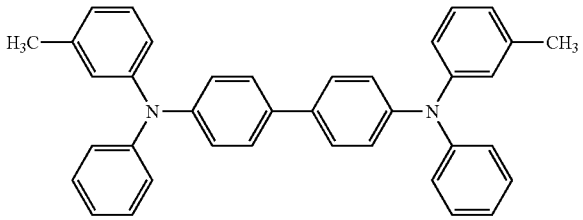

The step of applying the surface layer coating liquid onto a cylindrical support was performed by dip-coating the charge generating layer with the surface layer coating liquid. The step of applying the surface layer coating liquid was performed in an environment having a relative humidity of 45% and an ambient temperature of 25° C.

60 seconds after the completion of the applying step, the cylindrical support to which the surface layer coating liquid had been applied was held for 120 seconds in a device the inside of which had been brought into conditions in which relative humidity was 50% and ambient temperature was 25° C.

60 seconds after the completion of the cylindrical support holding step, the cylindrical support was placed in a blast drier the inside of which had been heated to 120° C., and was subjected to a drying step for 60 minutes.

Thus, an electrophotographic photosensitive member was produced which had as a surface layer a charge transporting layer 20 μm in thickness having depressed portions.

<Observation of Depressed Portions Formed>

The surface profile of the resultant electrophotographic photosensitive member was observed under magnification with a laser microscope (VK-9500 manufactured by KEYENCE CORPORATION). As a result, it was found that depressed portions each having a major axis diameter of 5.0 μm and a depth of 4.0 μm were formed at intervals of 0.5 μm. The average major axis diameter, average depth, number, and area ratio of depressed portions per 100 μm square were as shown in Table 2.

<Evaluation of Electrophotographic Photosensitive Member in Practical Operation>

The resultant photosensitive member was evaluated for other items in the same manner as in Example B-1. Table 2 shows the results.

Example B-5

A conductive layer, an intermediate layer, and a charge generating layer were formed in the same manner as in Example A-1.

<Formation of Depressed Portion by Condensation Method>

Next, 70 parts of the hole transportable compound represented by the structural formula (2) and 100 parts of a polycarbonate resin (IUPIRON Z400, manufactured by Mitsubishi Engineering-Plastics Corporation) were dissolved in a mixed solvent of 550 parts of monochlorobenzene and 280 parts of methylal, whereby an surface layer coating liquid containing a charge transporting substance was prepared. The step of preparing the application liquid for a surface layer was performed in an environment having a relative humidity of 45% and an ambient temperature of 25° C.

A step of applying the surface layer coating liquid onto a cylindrical support was performed by dip-coating the charge generating layer with the surface layer coating liquid. The step of applying the application liquid for a surface layer was performed in an environment having a relative humidity of 45% and an ambient temperature of 25° C.

180 seconds after the completion of the applying step, the cylindrical support to which the surface layer coating liquid had been applied was held for 180 seconds in a device the inside of which had been brought into conditions in which relative humidity was 50% and ambient temperature was 25° C.

60 seconds after the completion of the cylindrical support holding step, the cylindrical support was placed in a blast drier the inside of which had been heated to 120° C., and was subjected to a drying step for 60 minutes.

Thus, an electrophotographic photosensitive member was produced which had as a surface layer a charge transporting layer 20 μm in thickness having depressed portions.

<Observation of Depressed Portions Formed>

The surface shape of the resultant electrophotographic photosensitive member was observed under magnification with a laser microscope (VK-9500 manufactured by KEYENCE CORPORATION). As a result, it was found that depressed portions each having a major axis diameter of 7.8 μm and a depth of 1.5 μm were formed at intervals of 0.8 μm. The average major axis diameter, average depth, number, and area ratio of depressed portions per 100 μm square were as shown in Table 2.

<Evaluation of Electrophotographic Photosensitive Member in Practical Operation>

The resultant electrophotographic photosensitive member was evaluated for other items in the same manner as in Example B-1. Table 2 shows the results.

As can be seen from the above-mentioned results, the electrophotographic photosensitive member of the present invention suppresses the occurrence of image defects due to melt adhesion even in the case of low image density in a high-temperature, high-humidity environment, and has good cleaning performance.

Example B-6

An electrophotographic photosensitive member was produced in the same manner as in Example B-1 except that the composition of the charge transporting layer coating liquid in Example B-1 was changed as shown below, and the electrophotographic photosensitive member was evaluated in the same manner as in Example B-1. Table 2 shows the results.

—Charge Transporting Layer Coating Liquid—

50 parts of the copolymer type polyallylate resin represented by the structural formula (4) and 0.4 parts of a fluorine atom-containing resin (trade name: GF-300, manufactured by TOAGOSEI CO., LTD.) were dissolved in 350 parts of monochlorobenzene. After that, 8.5 parts of a tetrafluoroethylene resin powder (trade name: Rubron L-2, manufactured by DAIKIN INDUSTRIES, ltd.) was added as a lubricant to the resultant solution. After that, the resultant product was processed four times with a high-pressure dispersing machine (trade name: Microfluidizer M-110EH, manufactured by Microfluidics) at a pressure of 600 kgf/cm$^2$ to be uniformly dispersed. Further, the resultant dispersion was filtrated through a Polyflon filter (trade name PF-060, manufactured by ADVANTEC), whereby a lubricant-dispersed liquid was prepared. Thereafter, 50 parts of the copolymer type polyallylate resin represented by the structural formula (4) and 70 parts of a hole transportable compound represented by the structural formula (2) were dissolved in a mixed solvent of 250 parts of monochlorobenzene and 200 parts of methylal, then was mixed with the lubricant-dispersed liquid, and was stirred, whereby the charge transporting layer coating liquid was prepared.

Example B-7

An electrophotographic photosensitive member was produced in the same manner as in Example B-3 except that the composition of the surface layer coating liquid in Example B-3 was changed as shown below, and the electrophotographic photosensitive member was evaluated in the same manner as in Example B-3. Table 2 shows the results.

—Surface Layer Coating Liquid—

50 parts of a polycarbonate resin (IUPIRON Z400, manufactured by Mitsubishi Engineering-Plastics Corporation) and 0.25 part of a fluorine atom-containing resin (trade name: GF-300, manufactured by TOAGOSEI CO., LTD.) were dissolved in 350 parts of monochlorobenzene. After that, 5 parts of a tetrafluoroethylene resin powder (trade name: Rubron L-2, manufactured by DAIKIN INDUSTRIES, ltd.) were added as a lubricant to the resultant solution. After that, the resultant product was processed four times with a high-pressure dispersing machine (trade name: Microfluidizer M-110EH, manufactured by Microfluidics) at a pressure of 600 kgf/cm$^2$ to be uniformly dispersed. Further, the resultant dispersion was filtrated through a Polyflon filter (trade name PF-060, manufactured by ADVANTEC), whereby a lubricant-dispersed liquid was prepared. Thereafter, 50 parts of a polycarbonate resin (IUPIRON Z400, manufactured by Mitsubishi Engineering-Plastics Corporation) and 70 parts of a hole transportable compound represented by the structural formula (2) were dissolved in a mixed solvent of 200 parts of monochlorobenzene and 300 parts of methylal, then was mixed with the lubricant-dispersed liquid, and was stirred, whereby the surface layer coating liquid was prepared.

Comparative Example B-1

Processing and evaluation were performed in the same manner as in Example B-1 except that the mold used in Example B-1 was changed to a mold having cylindrical shapes each having a major axis diameter of 2.0 μm and a height of 2.0 μm and arranged at intervals of 10.0 μm. Table 2 shows the results.

Comparative Example B-2

Processing and evaluation were performed in the same manner as in Example B-1 except that the mold used in Example B-1 was changed to a mold having cylindrical shapes each having a major axis diameter of 15.0 μm and a height of 2.0 μm and arranged at intervals of 1.0 μm. Table 2 shows the results.

As can be seen from the above-mentioned results, the electrophotographic photosensitive member in the Comparative Example tended to cause a problem of melt adhesion because the average major axis diameter of depressed portions and the number of the depressed portions per 100 μm square were outside the range of the present invention.

TABLE 2

| | | Average major axis diameter (μm) | Average interval (μm) | Average depth (μm) | Number/ 100 μm square | Area ratio (%) | Melt adhesion | Toner escape due to cleaning failure |
|---|---|---|---|---|---|---|---|---|
| Example B- | 1 | 5.0 | 0.5 | 1.5 | 324 | 64 | A | A |
| | 2 | 8.1 | 2.5 | 1.0 | 94 | 48 | B | B |
| | 3 | 6.0 | 0.5 | 3.0 | 247 | 70 | A | A |
| | 4 | 5.0 | 0.5 | 4.0 | 350 | 69 | A | A |
| | 5 | 7.8 | 0.8 | 1.5 | 137 | 65 | A | A |
| | 6 | 5.0 | 0.5 | 1.6 | 324 | 64 | A | A |
| | 7 | 5.0 | 0.5 | 3.0 | 324 | 64 | A | A |
| Comparative | 1 | 2.1 | 10.2 | 1.5 | 64 | 2 | D | — |
| Example B- | 2 | 15.0 | 1 | 1.6 | 36 | 64 | D | — |

Example C-1

An electrophotographic photosensitive member was produced in the same manner as in Example A-1 except that the aluminum cylinder having a diameter of 30 mm and a length of 357.5 mm in Example A-1 was changed to an aluminum cylinder subjected to surface cutting, having a diameter of 84 mm and a length of 370.0 mm.

<Formation of Depressed Portions by Mold Pressing Profile Transfer>

The electrophotographic photosensitive member was subjected to surface processing with an apparatus having a constitution illustrated in FIG. 7 in which a mold for profile transfer illustrated in FIG. 16 (where hill shapes each having a major axis diameter of 7.5 μm at its bottom and a height of 2.0 μm were arranged at intervals of 0.5 μm) as used in Example A-3 was fitted. The temperature of the electrophotographic photosensitive member and the mold was controlled so that the temperature of the surface of the electrophotographic photosensitive member at the time of the processing was 110° C., and profile transfer was performed by rotating the photosensitive member in its circumferential direction while a pressure of 5.0 MPa was applied.

<Observation of Depressed Portions Formed>

The surface shape of the resultant electrophotographic photosensitive member was observed under magnification with a laser microscope (VK-9500 manufactured by KEYENCE CORPORATION). As a result, it was found that hill-shaped depressed portions each having a major axis diameter of 7.5 μm and a depth of 1.0 μm were formed at intervals of 0.5 μm as illustrated in FIG. 17. The average major axis diameter, average depth, number, and area ratio of depressed portions per 100 μm square were as shown in Table 3.

<Measurement of Elastic Deformation Rate and Universal Hardness (HU)>

The resultant electrophotographic photosensitive member was left standing in an environment having a temperature of 23° C. and a humidity of 50% RH for 24 hours. After that, the elastic deformation rate and universal hardness (HU) of the member were measured. As a result, the value of the elastic deformation rate was 55%, and the value of the universal hardness (HU) was 180 N/mm$^2$.

<Evaluation of Electrophotographic Photosensitive Member in Practical Operation>

The electrophotographic photosensitive member obtained as described above was mounted on a modified device (remodeled into a negative charge type) of an electrophotographic copying machine iRC6800 manufactured by Canon Inc., and was tested and evaluated as described below.

First, conditions for a potential were set so that the dark potential (Vd) and light potential (Vl) of the electrophotographic photosensitive member in an environment having a temperature of 23° C. and a humidity of 50% RH was −700 V and −200 V, respectively, and the initial potential of the electrophotographic photosensitive member was adjusted.

Next, a cleaning blade made of polyurethane rubber was set to be at a contact angle of 26° and a contact pressure of 30 g/cm$^2$ with respect to the surface of the electrophotographic photosensitive member.

After that, a durability test was performed in which 50,000 sheets of A4 size paper were printed in a 10-sheet monochromatic intermittent mode. A test chart having a printing ratio of 5% was used only for the first sheet of the 10 sheets, and a solid white image was used for the other nine sheets. After the completion of the durability test, a half tone test image was output, image defects on the output images were observed, and transfer efficiency was measured. In addition, defects such as chipping and gouging on the cleaning blade after the durability test were observed.

In addition, a ratio B/A of a driving current value B after the 50,000-sheet durability test of a motor for rotating the electrophotographic photosensitive member to an initial driving current value A of the motor was determined, and the determined value was defined as a relative torque increase rate.

In addition, a durability test in a high-temperature, high-humidity environment (30° C./80% RH) was performed in the same manner as described above, and evaluation was made on deterioration in dot reproducibility after the durability test resulting from smeared images. In Table 3, A indicates that dot reproducibility is good, B indicates that part of the contours of an image is unclear, and C indicates that the contours of an image are entirely unclear.

The electrophotographic photosensitive member of this Example showed good cleaning properties, and suppressed an increase in torque during the durability test. As a result, no image defects occurred throughout the durability test. In addition, the member had good dot reproducibility even in a high temperature and high humidity environment.

Example C-2

Processing and evaluation were performed in the same manner as in Example C-1 except that the mold used in Example C-1 was changed to such a mold for profile transfer as used in Example A-4 (where hexagonal columnar shapes each having a major axis diameter of 10.0 μm and a height of 2.0 μm were arranged at intervals of 1.0 μm). Table 3 shows the results. Values of the elastic deformation rate and universal hardness (HU) of the resultant photosensitive member were 55% and 180 N/mm$^2$, respectively.

Example C-3

Processing and evaluation were performed in the same manner as in Example C-1 except that the mold used in Example C-1 was changed to such a mold for profile transfer as used in Example A-13 (where cylindrical shapes each having a major axis diameter of 10.0 μm and a height of 2.0 μm were arranged at intervals of 1.0 μm) Table 3 shows the results. Values of the elastic deformation rate and universal hardness (HU) of the resultant photosensitive member were 55% and 180 N/mm$^2$, respectively.

Example C-4

Processing and evaluation were performed in the same manner as in Example C-1 except that the mold used in Example C-1 was changed to such a mold for profile transfer as used in Example A-12 (where cylindrical shapes each having a major axis diameter of 5.0 μm and a height of 2.0 μm and arranged at intervals of 2.0 μm). Table 3 shows the results. Values of the elastic deformation rate and universal hardness (HU) of the resultant photosensitive member were 55% and 180 N/mm$^2$, respectively.

Example C-5

An electrophotographic photosensitive member was produced in the same manner as in Example C-1. Next, the surface profile processing of the electrophotographic photosensitive member was carried out by the same laser processing as in Example A-15 instead of the mold pressing profile transfer.

<Observation of Depressed Portions Formed>

The surface profile of the resultant electrophotographic photosensitive member was observed under magnification with a laser microscope (VK-9500 manufactured by KEYENCE CORPORATION). As a result, it was found that cylindrical depressed portions each having a major axis diameter of 8.6 μm and a depth of 0.9 μm and having no edge were formed at intervals of 2.9 μm. The average major axis diameter, average depth, number, and area ratio of depressed shape portions per 100 μm square were as shown in Table 2.

The resultant photosensitive member was evaluated for other items in the same manner as in Example C-1. Table 3 shows the results. Values of the elastic deformation rate and universal hardness (HU) of the resultant photosensitive member were 55% and 180 N/mm$^2$, respectively.

As can be seen from the above-mentioned results, according to the present invention, an electrophotographic photosensitive member can be provided which is excellent in cleaning performance and can suppressing the occurrence of image defects due to melt adhesion. In particular, the electrophotographic photosensitive member is effective when images with low image density are continuously output.

Comparative Example C-1

An electrophotographic photosensitive member was produced in the same manner as in Example C-1. Next, the surface of the electrophotographic photosensitive member was processed by the same laser processing as in Comparative Example A-4 instead of the mold pressing profile transfer, and evaluation was made. Table 3 shows the results. Values of the elastic deformation rate and universal hardness (HU) of the resultant photosensitive member were 55% and 180 N/mm$^2$, respectively.

Comparative Example C-2

An electrophotographic photosensitive member was produced in the same manner as in Example C-1. Next, the surface of the electrophotographic photosensitive member was processed by the same laser processing as in Comparative Example A-5 instead of the mold pressing profile transfer, and evaluation was made. Table 3 shows the results. Values of the elastic deformation rate and universal hardness (HU) of the resultant photosensitive member were 55% and 180 N/mm$^2$, respectively.

Comparative Example C-3

An electrophotographic photosensitive member was produced in the same manner as in Example C-1. Next, the surface of the electrophotographic photosensitive member was processed by the same laser processing as in Comparative Example A-6 instead of the mold pressing profile transfer, and evaluation was made. Table 3 shows the results. Values of the elastic deformation rate and universal hardness (HU) of the resultant photosensitive member were 55% and 180 N/mm$^2$, respectively.

As can be seen from the above-mentioned results, the electrophotographic photosensitive member in the Comparative Example tended to cause a problem of melt adhesion because the average major axis diameter of depressed portions and the number of depressed portions per 100 μm square were outside the range of the present invention.

TABLE 3

| | | HU/ Elastic deformation rate | Average major axis diameter (μm) | Average interval (μm) | Average depth (μm) | Number/ 100 μm square | Area ratio (%) | Image/ Blade edge | Torque increase rate | Transfer efficiency | Dot reproducibility |
|---|---|---|---|---|---|---|---|---|---|---|---|
| Example C- | 1 | 180/55 | 7.5 | 0.5 | 1.0 | 144 | 65 | Good/Good | 1.1 | 95%< | A |
| | 2 | 180/55 | 10.0 | 1.0 | 1.0 | 105 | 68 | Good/Good | 1.1 | 95%< | A |
| | 3 | 180/55 | 10.0 | 1.0 | 1.0 | 81 | 64 | Good/Good | 1.1 | 95%< | B |
| | 4 | 180/55 | 5.0 | 2.0 | 1.0 | 204 | 40 | Good/Good | 1.2 | 95%< | B |
| | 5 | 180/55 | 8.6 | 2.9 | 0.9 | 76 | 43 | Good/Good | 1.2 | 95%< | A |
| Comparative example C- | 1 | 180/55 | 29.2 | 2.9 | 0.9 | 10 | 70 | Melt adhesion/ Partial gouging | 2.8 | 87% | C |
| | 2 | 180/55 | 20.5 | 2.1 | 0.9 | 20 | 65 | Melt adhesion/ Partial chipping | 2.3 | 90% | C |
| | 3 | 180/55 | 10.1 | 4.9 | 0.9 | 46 | 35 | Melt adhesion/ Partial chipping | 2.1 | 92% | B |

The present application claims the priority of each of Japanese Patent Application No. 2006-022896 filed on the thirty-first day of Jan., 2006, Japanese Patent Application No. 2006-022898 filed on the thirty-first day of Jan., 2006, Japanese Patent Application No. 2006-022899 filed on the thirty-first day of Jan., 2006, Japanese Patent Application No. 2006-022900 filed on the thirty-first day of Jan., 2006, and Japanese Patent Application No. 2007-016217 filed on the twenty-sixth day of Jan., 2007, the contents of which are incorporated herein by reference.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims benefit of Japanese Patent Applications No. 2006-022896, filed Jan. 31, 2006, No. 2006-022898, filed Jan. 31, 2006, No. 2006-022899 filed Jan. 31, 2006, No. 2006-022900, filed Jan. 31, 2006 and No. 2007-016217, filed Jan. 26, 2007, which are hereby incorporated by reference herein in their entirety.

What is claimed is:

1. An electrophotographic photosensitive member, comprising a support and a photosensitive layer provided on the support, wherein a plurality of depressed portions independent of each other are formed on the surface of the electrophotographic photosensitive member, the number of the depressed portions per 100 μm square is 76 or more and 1,000 or less, openings of the depressed portions have an average major axis diameter of 3.9 μm or more and 12.0 μm or less, and the depressed portions are formed at the entire region of the surface.

2. An electrophotographic photosensitive member according to claim 1, wherein the openings of the depressed portions have an area ratio of 40% or more.

3. An electrophotographic photosensitive member according to claim 1, wherein the openings of the depressed portions have an average major axis diameter of 5.0 μm or more and 10 μm or less.

4. An electrophotographic photosensitive member according to claim 1, wherein the number of the depressed portions per 100 μm square is 100 or more and 500 or less.

5. A process cartridge which integrally holds the electrophotographic photosensitive member according to claim 1 and at least one device selected from the group consisting of a charging device, a developing device, and a cleaning device, and is detachably mountable to a main body of an electrophotographic apparatus.

6. An electrophotographic apparatus, comprising the electrophotographic photosensitive member according to claim 1, a charging device, an exposing device, a developing device and a transferring device.

7. A process cartridge which integrally holds an electrophotographic photosensitive member and a cleaning device, and is detachably mountable to a main body of an electrophotographic apparatus, wherein the electrophotographic photosensitive member comprises a support and a photosensitive layer provided on the support, a plurality of depressed portions independent of each other are formed on the surface of the electrophotographic photosensitive member, the number of the depressed portions per 100 μm square is 76 or more and 1,000 or less, openings of the depressed portions have an average major axis diameter of 3.9 μm or more and 12.0 μm or less, the cleaning device comprises a cleaning blade, and the depressed portions are formed at least at an area of the surface, the area coming into contact with the cleaning blade.

8. An electrophotographic apparatus comprising an electrophotographic photosensitive member, a charging device, an exposing device, a developing device, a transferring device and a cleaning device, wherein the electrophotographic photosensitive member comprises a support and a photosensitive layer provided on the support, a plurality of depressed portions independent of each other are formed on the surface of the electrophotographic photosensitive member, the number of the depressed portions per 100 μm square is 76 or more and 1,000 or less, openings of the depressed portions have an average major axis diameter of 3.9 μm or more and 12.0 μm or less, the cleaning device comprises a cleaning blade, and the depressed portions are formed at least at an area of the surface, the area coming into contact with the cleaning blade.

* * * * *